US005611080A

United States Patent [19]

Skottheim

[11] Patent Number: 5,611,080

[45] Date of Patent: Mar. 18, 1997

[54] LIMB PROTECTOR

[75] Inventor: Leif Skottheim, Malung, Sweden

[73] Assignee: Jofa AB, Malung, Sweden

[21] Appl. No.: 216,653

[22] Filed: Mar. 23, 1994

[30] Foreign Application Priority Data

Apr. 2, 1993 [CA] Canada ..... 2093264

[51] Int. Cl.[6] ..... A41D 13/00; A41D 13/08

[52] U.S. Cl. ..... 2/16; 2/22

[58] Field of Search ..... 2/22, 16, 24, 2

[56] References Cited

U.S. PATENT DOCUMENTS 3,135,964 6/1964 Pender .
3,735,419 5/1973 Byrd .
3,761,960 10/1973 Woodcock ..... 2/22
4,692,946 9/1987 Jurga .
4,888,826 12/1989 Parsons, Jr., et al. .
4,999,847 3/1991 Barcelo ..... 2/22 X
5,222,256 6/1993 Wang ..... 2/24
5,452,475 9/1995 Hunt ..... 2/22

*Primary Examiner*—Paul C. Lewis
*Attorney, Agent, or Firm*—Fay, Sharpe, Beall, Fagan, Minnich & McKee

[57] ABSTRACT

The present invention relates to an articulated limb protection system and device for use in sports events such as ice hockey, street hockey, roller hockey and the like. The system or device comprises a buffer pocket which is disposed between an outer joint guard means and an inner joint guard means. The inner joint guard means is articulately connected to an adjacent limb guard means so that the inner joint guard means pivots relative to the limb member in response to bending action of the protected limb about the covered joint.

28 Claims, 9 Drawing Sheets

LIMB PROTECTOR

The present invention relates to an articulatable limb protection system for the protection of limb members such as the knee (joint), elbow (joint), etc. . . It, in particular, relates to a (leg\arm) protector which may for example be used in sports such as ice hockey, street hockey, roller hockey and the like.

Various kinds of limb protectors are known of the type arranged to at least partially encircle the limb of a person. Examples of such protectors are shown in U.S. Pat. Nos. 3,135,964, 3,735,419, 4,692,946 and 4,888,826; the entire contents of each of these patents is incorporated herein by reference.

Limb protectors for legs (as well as for arms) have conventionally comprised a hard outer shell directly overlaying and abutting a resilient shock absorbent padding which is suitably attached to the outer hard shell; the protector partially encircles the limb of the user about the area of a joint. For such laminate type constructions, the force of an impact in a joint area, while attenuated, is essentially directly transferred to the bones of the joint area such that not only may a painful sensation nevertheless be felt by the wearer but joint damage may also occur.

Various attempts have been made to design shin guards to protect the shin and knee cap from blows or impact forces resulting from being hit with a puck, hockey stick or the like; shin guards are known, for example, wherein the area between the knee cap and the shin is protected with padding or rigid members so as to afford some measure of protection. It is also known to provide buffer pockets in front of the shin, knee joint etc., to augment the shock absorbing characteristics of the limb guard; see for example U.S. Pat. Nos. 3,135,964 and 4,888,826. However, known limb guards do not provide a high degree of articulation coupled with a high degree of shock absorbance especially in the region of a joint such as an elbow or knee. Efforts are therefore continuing in order to develop a protector which provides the wearer with a high degree of movement (i.e. high articulation between various limb guard members) and shock absorbance.

It would be advantageous to have a protector device or system wherein the forces directed to the knee cap (or elbow) are distributed over a relatively large part of the leg (or arm), i.e. they are not directly transferred to the knee cap or elbow.

It would also be advantageous to have a limb protector whereby the elements or members of the protector are pivotably connected such that the protector is able to freely follow the bending movement of a leg about the knee (or arm about the elbow) in order to provide a comfortable union with the leg (or arm) of the wearer.

It would further be advantageous to provide a protection device or system with a high degree of articulation and which would provide protection in the shin to knee transition area as well as in the knee to thigh area; similarly for the transition areas around the elbow.

SUMMARY OF INVENTION

The present invention relates to an articulated limb protection system or protector device which provides the user with a high degree of limb bending movement; for example, a leg protection system in accordance with the present invention, permits the user to assume any position from squatting, through intermediate leg bending to a full upright stance.

In accordance with a leg limb aspect, the present invention provides for a leg protection system for protecting a person's knee and a leg member selected from a group comprising a person's shin and a person's thigh. The leg protection system is of the type arranged or configured to at least partially encircle a person's leg and comprises inner knee cap guard means for bearing on a person's knee cap, limb guard means, said limb guard means comprising
outer knee joint guard means and
leg guard means selected from a group comprising
shin guard means and thigh guard means,
said outer knee joint guard means being in overlying relationship to said inner knee cap guard means, such that said inner kneecap guard means nests in said outer knee joint guard means spacing means for spacing apart the inner knee cap guard means from the outer knee joint guard means such that a buffer pocket is defined therebetween, first articulation connection means for articulately connecting said outer knee joint guard means to said leg guard means such that said outer knee joint guard means is pivotably moveable, relative to said leg guard means, in response to bending movement of the leg about the knee and second articulation connection means for articulately connecting said inner knee cap guard means to said leg guard means such that said inner knee cap guard means is pivotably moveable, relative to said leg guard means, in response to bending movement of the leg about the knee.

In accordance with the present invention a leg protection system in addition to protecting the knee area may also protect the shin area, the thigh area or both the shin and thigh area. The inner knee cap guard means may, for example, as desired, be articulately connected to the shin guard means or the thigh guard means.

Thus in accordance with another aspect the present invention provides for a leg protection system for protecting a person's shin, knee and thigh, said leg protection system being of the type arranged or configured to at least partially encircle a person's leg, said leg protection system comprising shin guard means, inner knee cap guard means for bearing on a person's knee cap, outer knee joint guard means, said outer knee joint guard means being in overlying relation to said inner knee cap guard means, such that said inner kneecap guard means nests in said outer knee joint guard means thigh guard means, spacing means for spacing apart the inner knee cap guard means from the outer knee joint guard means such that a buffer pocket is defined therebetween, first articulation connection means for articulately connecting said outer knee joint guard means to said shin guard means and to said thigh guard means such that said outer knee joint guard means is pivotably moveable, relative to said shin guard means, in response to bending movement of the leg about the knee and said thigh guard means is pivotably moveable, relative to said outer knee joint guard means in response to bending movement of the leg about the knee and second articulation connection means for articulately connecting said inner knee cap guard means to said shin guard means such that said inner knee cap guard means is pivotably moveable, relative to said shin guard means, in response to bending movement of the leg about the knee.

In accordance with a leg protector of the present invention, the transition areas between the and upper and lower legs may be covered by overlapping parts of the elements thereof.

Thus in accordance with another aspect the present invention provides for a leg protector for protecting a person's shin, knee and thigh, said leg protector being of the type arranged or configured to at least partially encircle a person's leg, said leg protection system comprising an inner knee cap guard means comprising a resilient pad element for bearing on a person's knee cap, a leg guard, said leg guard comprising a shin guard means comprising a rigid outer shell element overlying a resilient shin pad element, an outer knee joint guard means comprising a relatively rigid outer shell element, and a thigh guard means comprising a rigid outer shell element overlying a resilient thigh pad element, said outer knee guard means being in overlying relationship to said inner knee cap guard means, such that said inner kneecap guard means nests in said outer knee joint guard means said outer knee joint guard means, when the leg of the person is straight, being in overlapping relation to said shin and thigh guard means, means for attaching each of said resilient pad elements to a respective rigid outer shell element, spacing means for spacing apart the inner knee cap guard means from the outer knee joint guard means such that a buffer pocket is defined therebetween, first articulation connection means for articulately connecting said outer knee guard means to said shin guard means and to said thigh guard means such that said outer knee joint guard means is pivotably moveable, relative to said shin guard means, in response to bending movement of the leg about the knee and said thigh guard means is pivotably moveable, relative to said outer knee joint guard means, in response to bending movement of the leg about the knee, and second articulation connection means for articulately connecting said inner knee cap guard means to said shin guard means such that said inner knee cap guard means is pivotably moveable, relative to said shin guard means, in response to bending movement of the leg about the knee.

In accordance with the present invention, the spacing means may take any desired form or configuration keeping in mind the purpose thereof, namely to space apart the outer knee joint element and the inner knee cap guard element so as to provide a buffer pocket. The spacing means may also facilitate the distribution of impact forces directed at a joint (such as a knee) over a larger part of the wearers limb. The spacing means may be a separate element or may comprise the inner knee cap guard means itself, e.g. a peripheral part of the inner knee cap guard means. The spacing means may be of any (known) resilient material suitable for use in the context of limb protection devices and systems.

Thus in accordance with the present invention the spacing means may comprise a peripheral portion of the inner knee cap guard means. The peripheral portion may be configured relative to the outer knee joint guard means, the shin guard means and the thigh guard means such that the inner knee cap guard means nests in the outer knee joint guard means.

Alternatively, in accordance with the present invention, the spacing means may comprise a resilient spacing means e.g. a resilient pad element. A resilient spacer pad element may be configured relative to the outer knee joint guard means, the inner knee cap guard means, the shin guard means and the thigh guard means such that the spacer pad element nests in the outer knee joint guard means between the inner knee cap guard means and the outer knee joint guard means; such that the inner knee cap guard means nests in the spacer pad element; and such that in response to bending movement of the leg about the knee, the inner knee cap guard means is able to slidably engage the spacer pad element.

The inner knee cap guard means may also include a rigid outer shell element overlying the resilient pad element thereof, the leg protector including means for attaching the resilient pad element of said inner knee cap guard to the rigid shell thereof. The rigid shell element of the inner knee cap means is disposed between said outer knee joint guard means and the resilient pad element of said inner knee guard means, i.e. so that the resilient pad bears on the knee cap of a person and not the hard shell thereof.

In accordance with the present invention the first articulation connection means may take on any form or configuration which provides for the desired articulating movement of the protector elements relative to each other. The first articulation connection means may for example, comprise first flexible strap means (for connecting the outer knee joint guard means to the shin guard means) and second flexible strap means (for connecting the outer knee joint guard means to the thigh guard means). The strap means may be fixed to the other elements in any suitable fashion so as to interconnect the elements of the protector in an articulatable fashion, e.g. by stitching, rivet connectors, etc,..

The second articulation connection means may also take on any form or configuration which provides for the desired articulating movement of the inner knee cap guard relative to the protector element it is connected to. The second articulation connection means may, for example, comprise a flexible member in the form of a (composite) web or strap about which a pivot type movement may occur during use.

In accordance with another aspect the present invention provides for a leg protector for protecting a person's shin, knee and thigh, said leg protector being of the type arranged or configured to at least partially encircle a person's leg, said leg protection system comprising an inner knee cap guard means comprising a resilient pad element for bearing on a person's knee cap, a leg guard, said leg guard comprising a shin guard means comprising a rigid outer shell element overlying a resilient shin pad element, an outer knee joint guard means comprising a rigid outer shell element overlying a resilient knee pad element, and a thigh guard means comprising a rigid outer shell element overlying a resilient thigh pad element, said outer knee guard means being in overlying relationship to said inner knee cap guard means, the rigid outer shell element of said outer knee joint guard means, when the leg of the person is straight, being in overlapping relation to the rigid outer shell elements of said shin and thigh guard means, means for attaching each of said pad elements to a respective rigid outer shell element, a resilient spacing means for spacing apart the inner knee cap guard means from the outer knee joint guard means such that a buffer pocket is defined therebetween, first articulation connection means for articulately connecting said outer knee guard means to said shin guard means and to said thigh guard means such that said outer knee joint guard means is pivotably moveable, relative to said shin guard means, in response to bending movement of the leg about the knee and said thigh guard means is pivotably moveable, relative to said outer knee joint guard means, in response to bending movement of the leg about the knee, said first articulation connection means comprising first flexible strap means for connecting said outer knee joint guard means to said shin guard means and second flexible strap means for connecting said outer knee joint guard means to said thigh guard means, said first and second flexible strap means being in underlying relation with respect to the rigid outer shell elements of said shin, outer knee joint and thigh guard means, and second articulation connection means for articulately connecting said inner knee cap guard means to said shin guard means such that said inner knee cap guard means is pivotably moveable, relative to said shin guard means, in response to bending movement of the leg about the knee.

In accordance with a further arm limb aspect, the present invention provides for an arm protection system for protecting a person's elbow and an arm member selected for a group comprising a person's forearm and a person's upper arm, said arm protection system being of the type arranged or configured to at least partially encircle a person's arm, said arm protection system comprising inner elbow guard means for bearing on a person's elbow, limb guard means, said limb guard means comprising outer elbow joint guard means, and arm guard means selected from a group comprising forearm guard means and upper arm guard means, said outer elbow joint guard means being in overlying relationship to said inner elbow guard means, such that said inner elbow guard means nests in said outer elbow joint guard means spacing means for spacing apart the inner elbow guard means from the outer elbow joint guard means such that a buffer pocket is defined therebetween, first articulation connection means for articulately connecting said outer elbow joint guard means to said arm guard means such that said outer elbow joint guard means is pivotably moveable, relative to said arm guard means, in response to bending movement of the arm about the elbow and second articulation connection means for articulately connecting said inner elbow guard means to said arm guard means such that said inner elbow guard means is pivotably moveable, relative to said arm guard means, in response to bending movement of the arm about the elbow.

In accordance with the present invention an arm protection system in addition to protecting the elbow area may also protect the forearm area, the upper arm area or both the forearm and upper arm areas. The inner elbow guard means may, for example, as desired, be articulately connected to the forearm guard means or the upper arm guard means.

The previous comments with respect to the spacing means, first articulation means, the rigid outer shell of the inner knee cap guard means, etc. apply in analogous fashion to the arm protector in analogous fashion.

In accordance with an additional arm aspect of the present invention there is provided an arm protection system for protecting a person's forearm, elbow and upper arm, said arm protection system being of the type arranged or configured to at least partially encircle a person's arm, said arm protection system comprising forearm guard means, inner elbow guard means for bearing on a person's elbow, outer elbow joint guard means, said outer elbow joint guard means being in overlying relationship to said inner elbow guard means, such that said inner elbow guard means nests in said outer elbow joint guard means upper arm guard means, spacing means for spacing apart the inner elbow guard means from the outer elbow joint guard means such that a buffer pocket is defined therebetween, first articulation connection means for articulately connecting said outer elbow joint guard means to said forearm guard means and to said upper arm guard means such that said outer elbow joint guard means is pivotably moveable, relative to said forearm arm guard means, in response to bending movement of the arm about the elbow and said upper arm guard means is pivotably moveable, relative to said outer elbow joint guard means, in response to bending movement of the arm about the elbow and second articulation connection means for articulately connecting said inner elbow guard means to said forearm guard means such that said inner elbow guard means is pivotably moveable, relative to said forearm guard means, in response to bending movement of the arm about the elbow.

In accordance with another arm aspect of the present invention there is provided an arm protector for protecting a person's forearm, elbow and upper arm, said arm protector being of the type arranged or configured to at least partially encircle a person's arm, said arm protector comprising an inner elbow guard means comprising a resilient pad element for bearing on a person's elbow, an arm guard, said arm guard comprising a forearm guard means, an outer elbow joint guard means, and a upper arm guard means, said forearm guard means comprising a rigid outer shell element overlying a resilient forearm pad element, said outer elbow joint guard means comprising a rigid outer shell element, said upper arm guard means comprising a rigid outer shell element overlying a resilient upper arm pad element, said outer elbow joint guard means being in overlying relationship to said inner elbow guard means, such that said inner elbow guard means nests in said outer elbow joint guard means said outer elbow joint guard means, when the arm of the person is straight, being in overlapping relation to said forearm and upper arm guard means, means for attaching each of said resilient pad elements to a respective rigid outer shell element, spacing means for spacing apart the inner elbow guard means from the outer elbow joint guard means such that a buffer pocket is defined therebetween, first articulation connection means for articulately connecting said outer elbow joint guard means to said forearm guard means and to said upper arm guard means such that said outer elbow joint guard means is pivotably moveable, relative to said forearm guard means, in response to bending movement of the arm about the elbow and said upper arm guard means is pivotably moveable, relative to said outer elbow joint guard means, in response to bending movement of the arm about the elbow, and second articulation connection means for articulately connecting said inner elbow guard means to said forearm guard means such that said inner elbow guard means is pivotably moveable, relative to said forearm guard means, in response to bending movement of the arm about the elbow.

In accordance with a further arm aspect of the present invention there is provided an arm protector for protecting a person's forearm, elbow and upper arm, said arm protector being of the type arranged or configured to at least partially encircle a person's arm, said arm protector comprising an inner elbow guard means comprising a resilient pad element for bearing on a person's elbow, an arm guard, said arm guard comprising a forearm guard means, an outer elbow joint guard means, and a upper arm guard means, said forearm guard means comprising a rigid outer shell element overlying a resilient forearm pad element, said outer elbow joint guard means comprising a rigid outer shell element overlying a resilient elbow pad element, said upper arm guard means comprising a rigid outer shell element overlying a resilient upper arm pad element, said outer elbow guard means being in overlying relationship to said inner elbow guard means, the relatively rigid outer shell element of said outer elbow guard means, when the arm of the person is straight, being in overlapping relation to the relatively rigid outer shell elements of said forearm and upper arm guard means, means for attaching each of said resilient pad elements to a respective rigid outer shell element, a resilient spacing means for spacing apart the inner elbow cap guard means from the outer elbow joint guard means such that a buffer pocket is defined therebetween, first articulation connection means for articulately connecting said outer elbow guard means to said forearm guard means and to said upper arm guard means such that said outer elbow joint guard means is pivotably moveable, relative to said forearm guard means, in response to bending movement of the arm about the elbow and said upper arm guard means is pivotably moveable, relative to said outer elbow joint guard means, in response to bending movement of the arm about the elbow, said first articulation connection means comprising first flexible strap means for connecting said outer elbow joint guard means to said forearm guard means and second flexible strap means for connecting said outer elbow joint guard means to said upper arm guard means, said first and second flexible strap means being in underlying relation with respect to the relatively rigid outer shell elements of said forearm, outer elbow joint and upper arm guard means and second articulation connection means for articulately connecting said inner elbow guard means to said forearm guard means such that said inner elbow guard means is pivotably moveable, relative to said forearm guard means, in response to bending movement of the arm about the elbow.

The various elements of a protector in accordance with the present invention may be made from (known) materials suitable for limb protection type systems or devices; see, for example, the materials mentioned in U.S. Pat. No. 4,692,946 (the entire contents of U.S. Pat. No. 4,692,946 are incorporated herein by reference).

The fastening means for connecting the various elements of a protector in accordance with the present invention may take any suitable form. A resilient pad may, for example, be secured to a hard shell by (heavy duty) stitching. Rivet connections may also be used. The fasteners may be of the detachable type, e.g. snap type fasteners.

In accordance with the present invention, the expressions "articulation connection", "articulation connection means" and the like are to be understood as referring to any connection whatsoever, which allows the so connected elements of the leg protector to follow the bending movement or motion of a leg or arm about the joint of the elbow or of the knee while the protector is maintained in operative position on the leg or arm.

In drawings which illustrate example embodiments of the protective system or device of the present invention:

Figure 1:
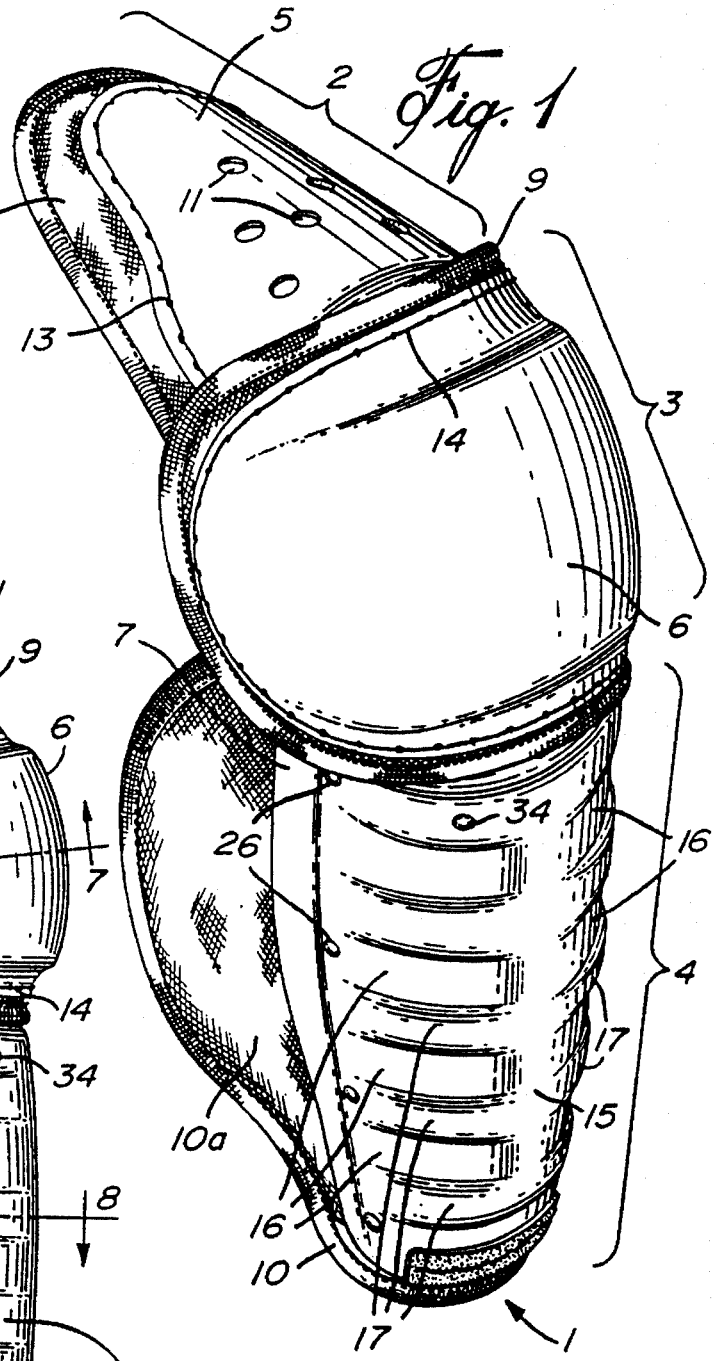
FIG. 1 is a front perspective view of an example leg protection device in accordance with the present invention, the device being arranged to partially encircle the leg of a user.
Figure 9:
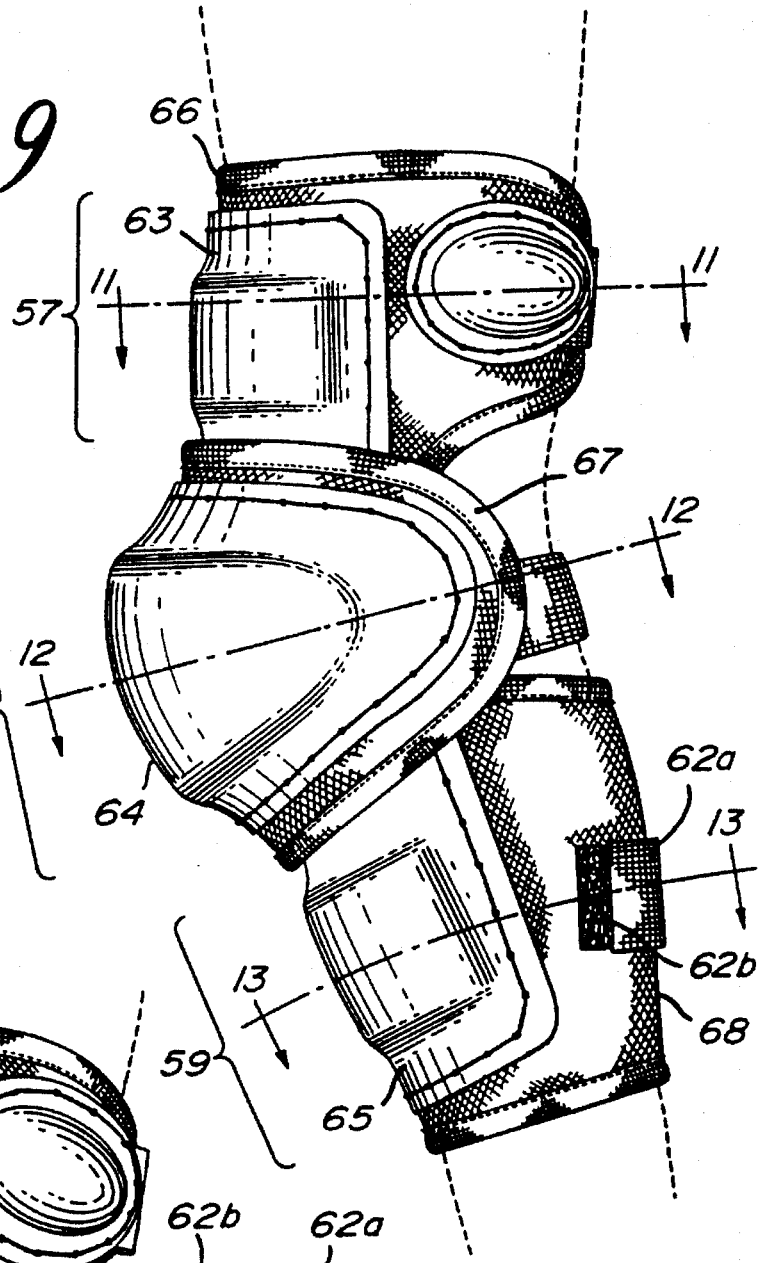
FIG. 9 shows a side view of an example arm protector device in accordance with the present invention in an essentially straight unbent position.
Figure 15:
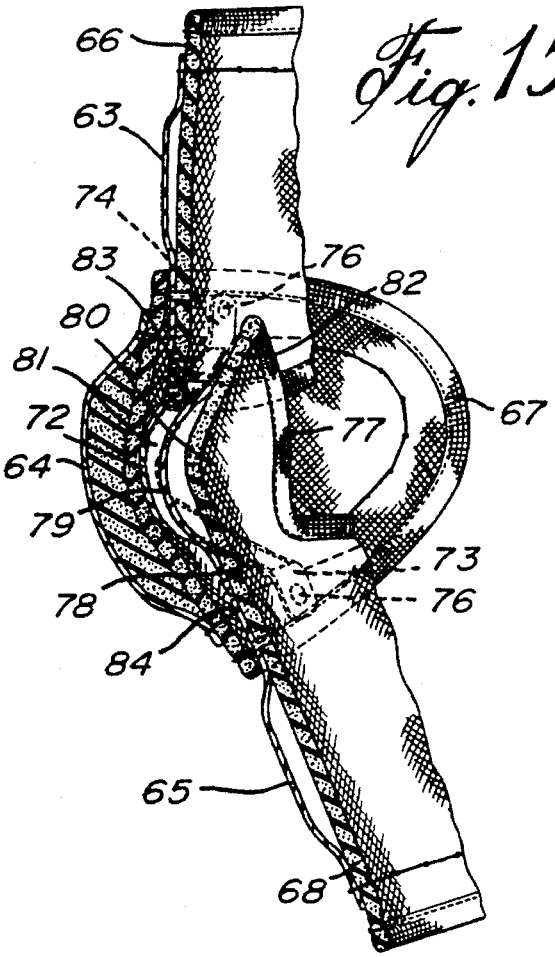
Figure 11:
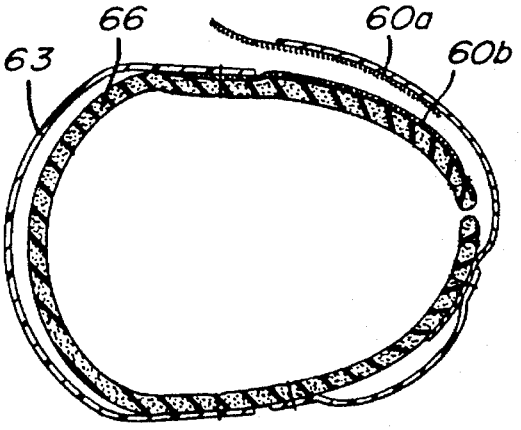
FIG. 11 is a cross section view along 11—11 of FIG. 9.
Figure 12:
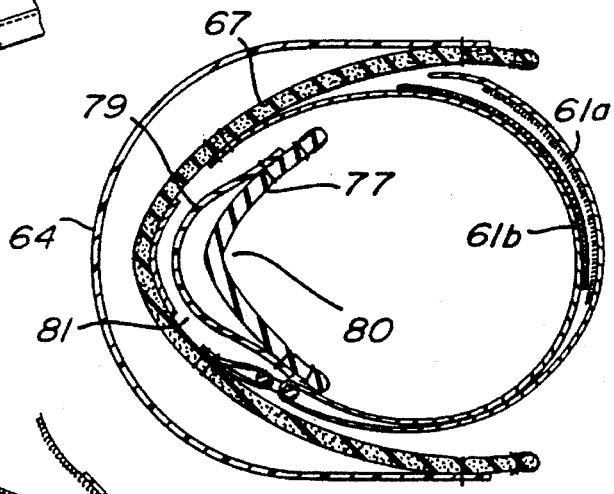
FIG. 12 is a cross section view along 12—12 of FIG. 9.
Figure 13:
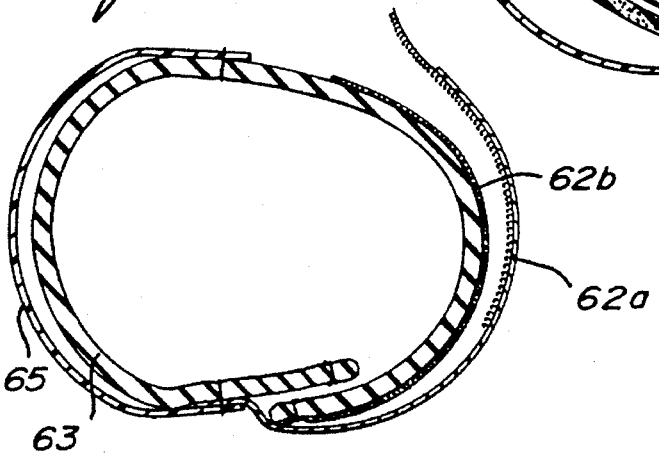
FIG. 13 is a cross section view along 13—13 of FIG. 9.
Figure 16:
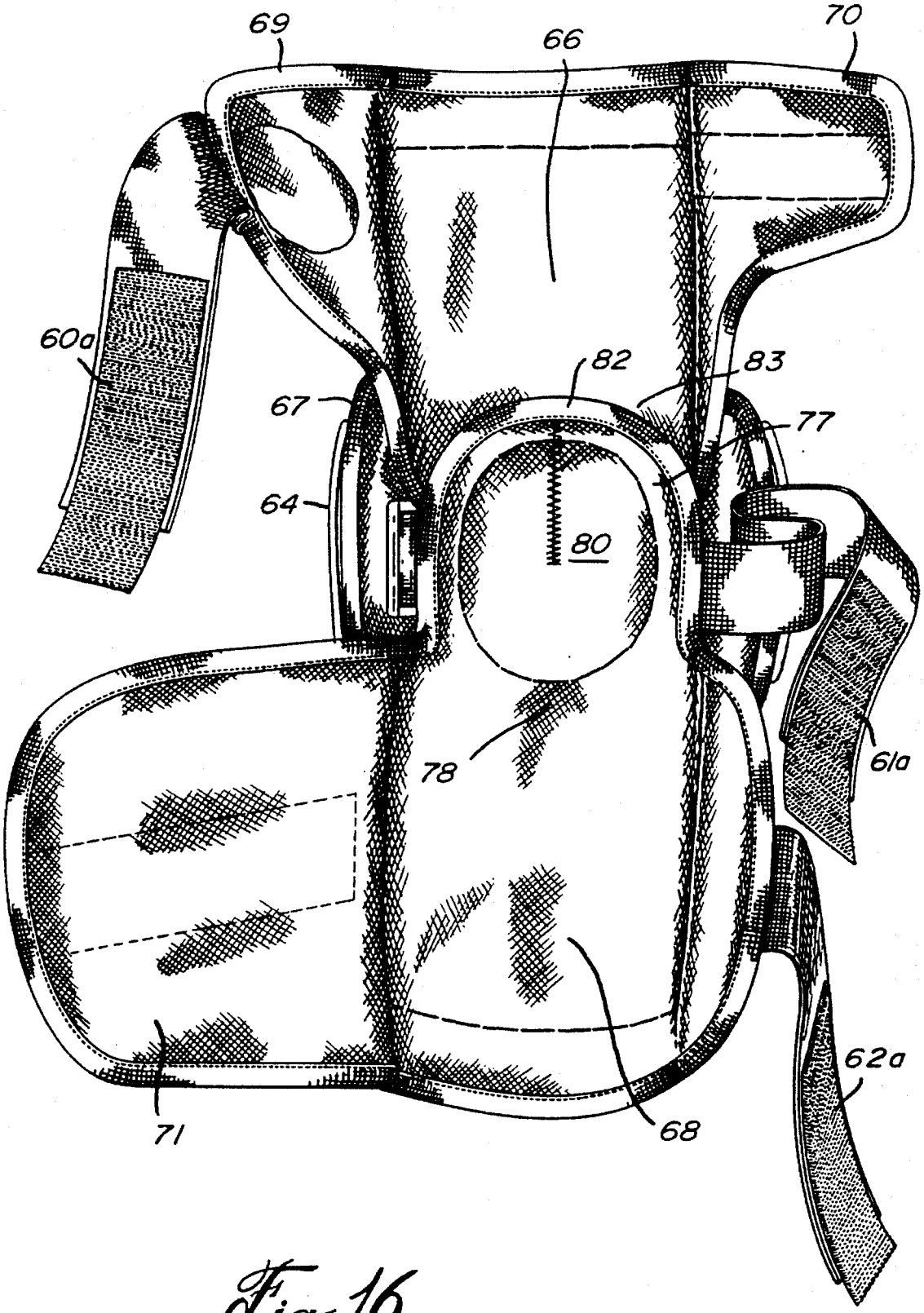

FIG. 15 is on the same page of drawings as FIGS. 11 to 13 and is a cross-sectional view of the arm protection device of FIG. 9 along the longitudinal center line thereof; and FIG. 16 shows a back view into the interior of the arm protector of FIG. 9; and Referring to FIG. 1, the leg protection device 1 shown has three main components, namely, an upper thigh portion 2, a middle knee portion 3, and a lower shin portion 4; in accordance with the present invention and, if desired, the upper thigh portion 2 may not be present such that the device would in this case be essentially a shin and knee protector.

Figure 3:
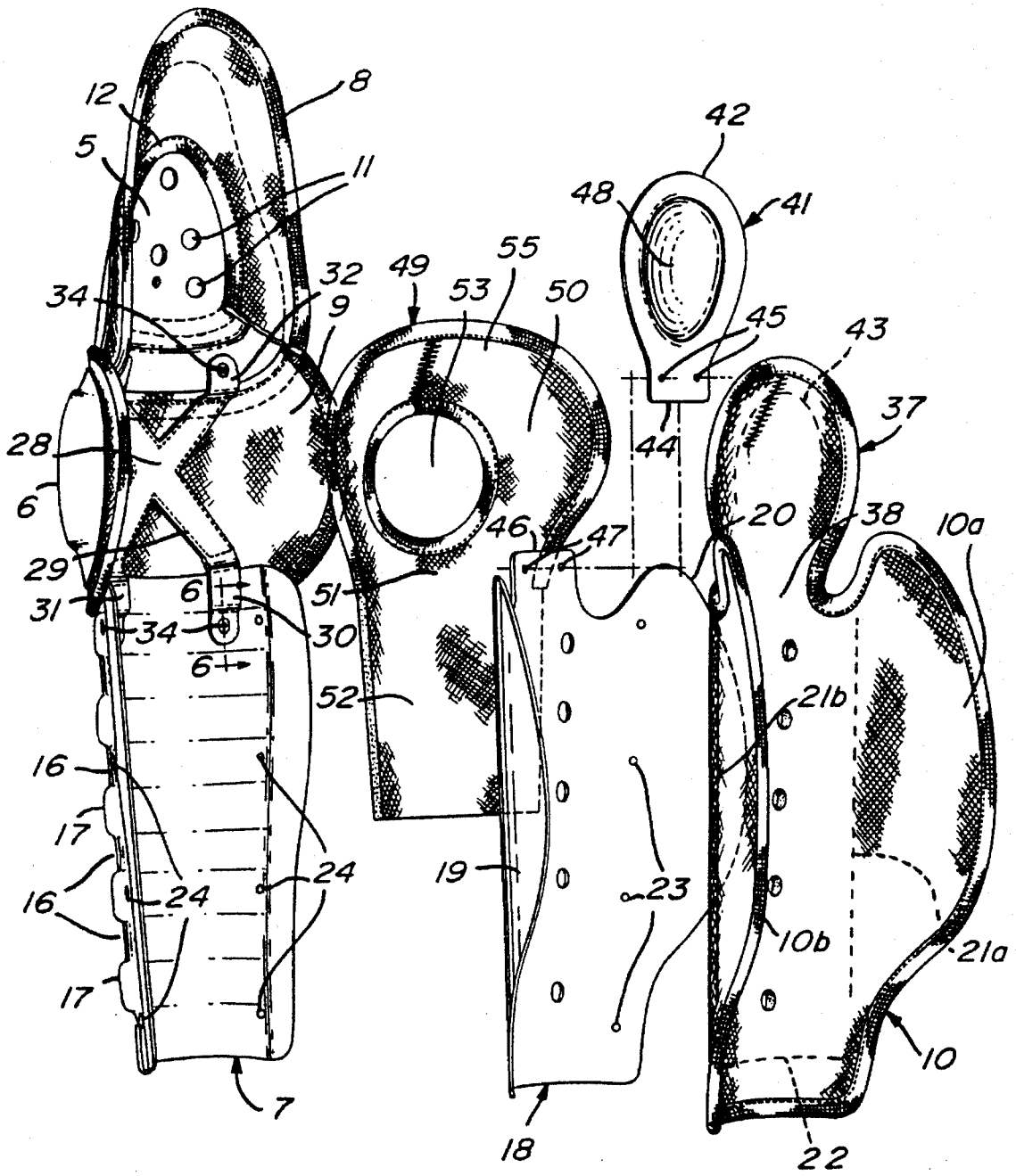
FIG. 3 is an exploded partially cut-out schematic rear view of the leg protection device of FIG. 1 wherein various components of the device are illustrated.
Figure 6:
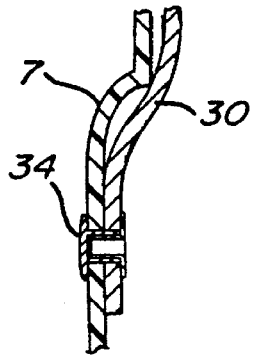
FIG. 6 is on the same drawing page as FIG. 3 and shows an example rivet type connection means used to attach the flexible webs or straps of the articulation means to the hard shell elements of the thigh and shin guard members.
Figure 7:
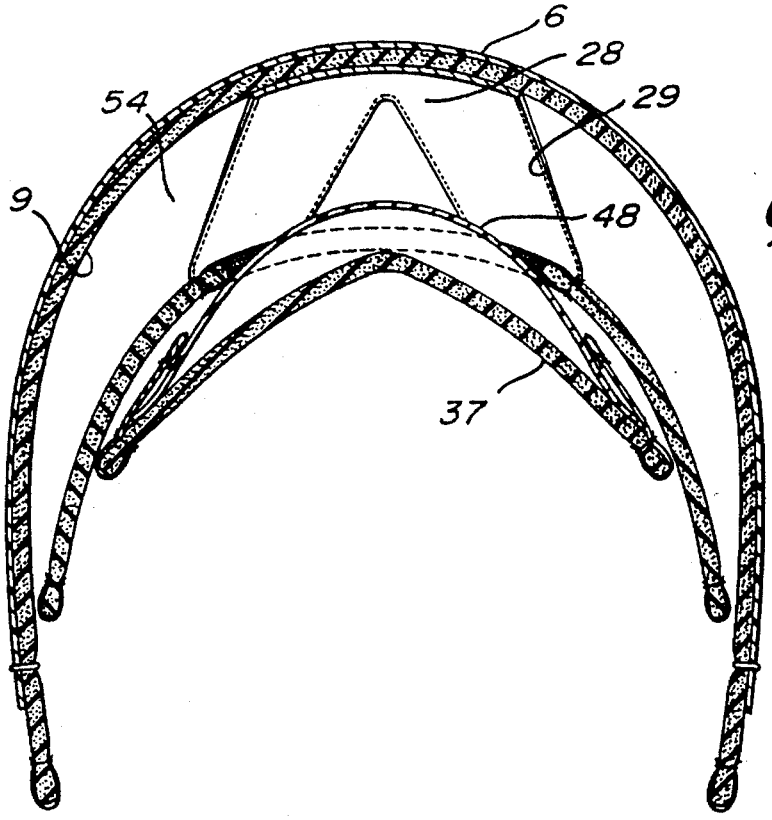
FIG. 7 shows a cross-sectional view of the knee portion along 7—7 of the device as shown in FIG. 2.
Figure 8:
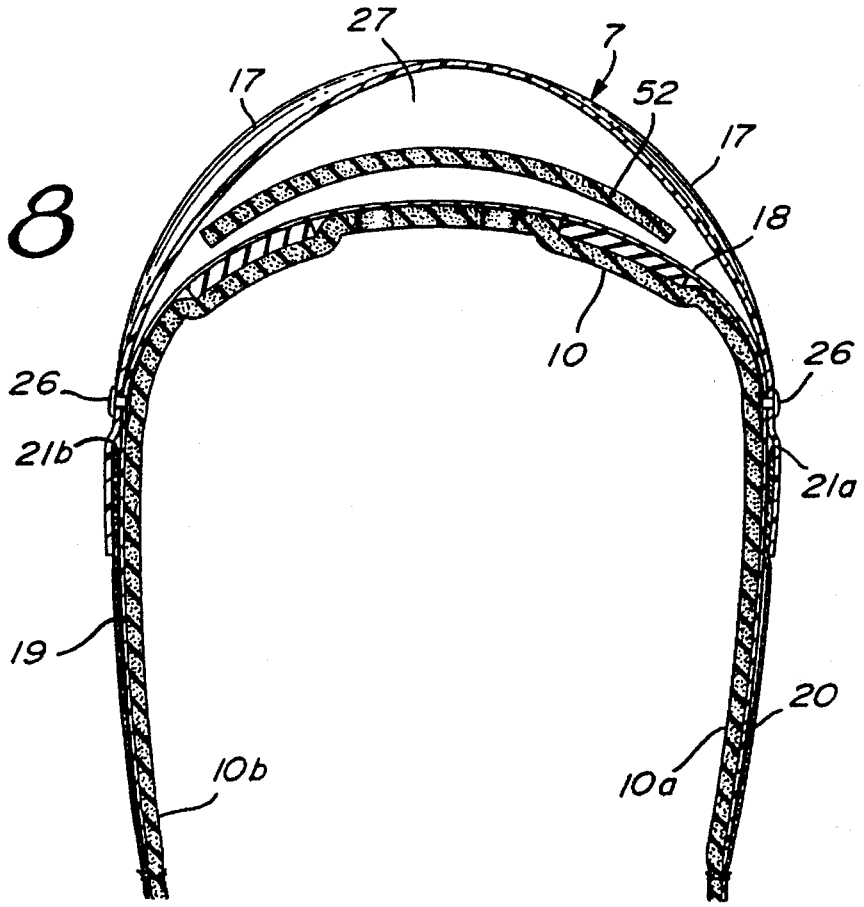
FIG. 8 shows a cross-sectional view of the shin portion along 8—8 of the device as shown in FIG. 2.

As may be seen from FIGS. 3, 7 and 8, each of the portions 2,3 and 4 of the leg protector is concavely curved about its longitudinal axis (i.e. the length axis of the leg) such that when the protector is placed on a leg it partially encircles the wearers leg. The leg protector may be maintained in place on a leg in any suitable manner, for example by the use of tape, elastic bands, string laces, etc. around the shin and thigh portions 2, and 4 or it may be maintained on the limb by a leg sock which covers the protector.

The knee portion 3 has an outer joint guard part and an inner kneecap guard part; the inner guard part will be discussed below in relation to the shin portion 4.

Returning to FIG. 1, the thigh portion 2, the outer knee joint guard part of the middle knee portion 3 and the shin portion 4 each comprises a protective relatively rigid outer shell 5, 6 and 7 respectively. These outer rigid shells overlie respective relatively resilient pad elements 8, 9 and 10 respectively.

The thigh portion 2 has a generally triangular like shape. The rigid thigh shell 5 has a number of openings (some of which are designated by the reference number 11) which pass therethrough. As may be seen, when viewing the leg protector from the underside, (see FIGS. 3 and 4), the thigh pad 8 has a central opening surrounded by a border 12; the holes 11 are disposed within the confines of the border 12. The rigid thigh shell 5 and the pad 8 are sized such that the border edges of the pad 8 extend beyond the peripheral edges of the shell 5. The rigid thigh shell is attached to the pad 8 by stitching 13.

The outer joint guard part of the knee portion 3, as mentioned above, comprises a rigid outer shell 6. The rigid outer shell 6 overlies a relatively resilient pad 9. The rigid knee joint shell 6 and the pad 9 are sized such that the border edges of the pad 9 extend beyond the peripheral edges of the shell 6. The rigid outer knee joint shell 6 is attached to the pad 9 by stitching 14, i.e. the shell 6 is attached adjacent to the periphery of the pad 9.

The outer joint guard part of the knee portion 3 is shaped or configured such that it will cover the front and side parts of the knee joint area of the leg of a wearer. The knee area is protected primarily by the outer knee shell 6, which is arranged (e.g. in relation to the surface curvature) such that the frontally acting forces and lateral forces are guided past the knee-cap and its adjacent fragile ligaments and articular cartilage and are transferred to stronger, surrounding parts of the knee-joint.

The shin portion 4 comprises a relatively rigid outer shin shell 7 which has a central longitudinally extending elongated portion 15. A plurality of depressions (a number of which are designated with the reference number 16) are disposed on both sides of the central elongated portion 15. The depressions 16 are spaced apart by a plurality of transversely extending rib like structures (a number of which are designated by the reference number 17) which are on both sides of the central portion 15. These ribs assist in reinforcing the rigidity of the outer shin shell 7.

As mentioned above the relatively rigid outer shin shell 7 overlies a relatively resilient pad 10. Referring to FIGS. 1 to 4, the pad 10 is provided with side wing pad portions 10*a* and 10*b* which serve as calf protecting elements.

The shin portion 4 may, as shown in FIG. 3, include a support member 18 which generally corresponds in shape to the shape of the pad 10. The upper portions of the pad 10 and the support 18 include elements which relate to an inner knee cap guard member which shall be described below.

The support 18, for example, has side wing portions 19 and 20 which have a shape which corresponds to that of respective side wing portions 10*a* and 10*b* of the pad 10.

The wing portions 10*a* and 10*b* of pad 10 each have a pouch. The interior of each pouch is shaped to receive a respective support side wing portion 19 or 20 through a respective slit opening 21*a* (and 21*b*) in the side wall of the respective side wing pad portion, i.e. a support side wing portion fits into a respective pouch in the manner of a foot (i.e. support wing) into a sock (i.e. pouch). The lower part of the pad 10 also has a pouch with a slit opening 22 for similarly receiving the lower edge portion of the support 18. The support side wing portions and the lower edge of the support of an assembled leg protector are thus covered from view; see FIGS. 1 and 2.

Turning back to FIG. 3, the support 18 is of a relatively thin flexible plastic material. The support 18 is provided with a series of holes along both sides or flanks thereof (some of the holes along one side of the support 18 are designated with the reference number 23). The outer rigid shin shell 7 is provided with a corresponding series of holes along its flanks (some of which are designated with the reference number 24). The holes 23 and 24 are disposed such that they may line up one with the other so that rivets (some of which are designated with the reference numeral 26 in FIGS. 1 and 2) may be inserted therein for connecting the support 18 to the shin shell 7; if desired any other (known) connection means may, of course, be used to connect the support 18 to the shell 7.

Figure 4:
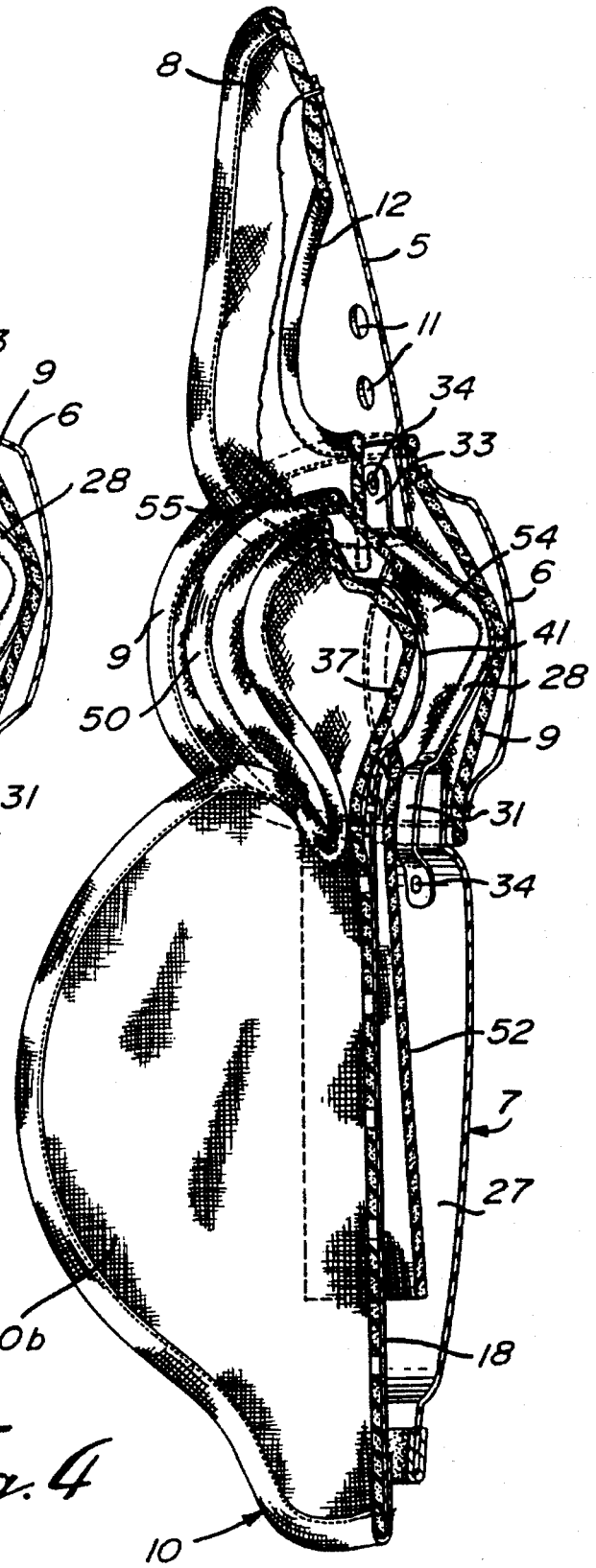
FIG. 4 is a cross-sectional view of the leg protection device, as shown in FIG. 2, along the longitudinal center line of the device.

The support 18 is fixed to opposite side portions of the shell 7 so as to inhibit collapse of the transverse concave configuration of the shin shell 7 due to impact forces, i.e. from a flying puck, a hockey stick, etc.. Thus as seen in FIGS. 4 and 8, when the support 18 is connected to the shin shell 7 and the pad 10 is disposed thereabout, the support 18 will span the interior of the shin shell 7 such that a buffer pocket 27 is defined between the outer shell 7 and the pad 10; the support 18 being between the pad 10 and the shell 7. The buffer pocket 27 will tend to augment the protective action of the shin guard portion 4 since the force of an impact will be distributed over a relatively larger area of the shin than the point of impact on the shin shell 7, i.e. an increased cushioning effect on the shin bone part of the pad 10 may thus be achieved.

The thigh portion 2, the outer part of the knee joint portion 3 and the shin portion 4 are connected together by an articulation connection means comprising first and second flexible web or strap means. The articulation connection means is flexible so as to permit unrestricted movement of the knee-joint.

Figure 5:
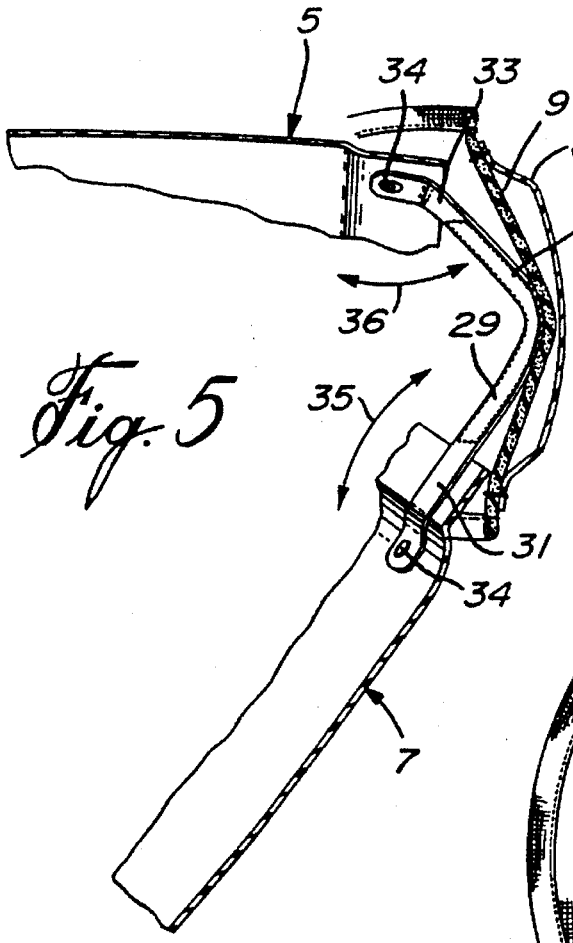
FIG. 5 is a partial cutaway view similar to that of FIG. 4, except that the view shows the device in a bent position with portions of the leg protector removed.

Referring to FIG. 3, the first articulation connection means comprises a criss cross web or strap member 28 which is sewn onto the pad 9; the stitching is indicated by the dotted line 29. As may be seen the outer knee joint part of the knee portion 3 is in overlapping relation to the other portions 2 and 4 (i.e. the outer knee joint part overlaps the adjacent edge portions of the other two portions 2 and 4). The free band ends 30, 31, 32 and 33 of strap member 28 (i.e. the portions thereof not stitched to the pad 19) are attached to the rigid shells 5 and 7 by rivet type connections (indicated generally by the reference numeral 34); the band end 33 is shown in FIGS. 4 and 5. The first flexible strap means referred to above comprises the free ends 30 and 31 while the second flexible strap means referred to above comprises the free ends 32 and 33.

Figure 2:
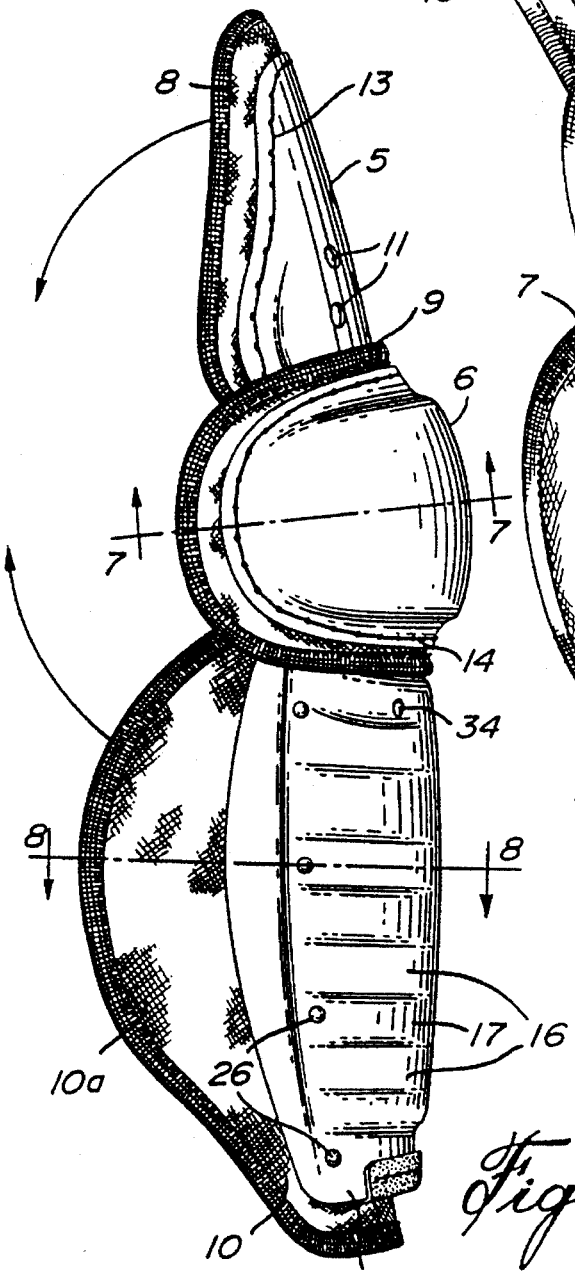
FIG. 2 is a side view of the leg protection device of FIG. 1.

Referring to FIG. 5, the first flexible strap means permits pivotable back and forth movement of the outer knee shell 6 relative to the shin shell 7 in response to the bending (or articulate) movement of the leg about the knee (the movement occurring in the direction of the arrow 35). Similarly, the second flexible strap means permits pivotable back and forth movement of the thigh shell 5 relative to the outer knee shell 6 in response to the bending (or articulate) movement of the leg about the knee (the movement occurring in the direction of the arrow 36); FIG. 2 shows the leg protector in a more or less straight position whereas FIG. 1 shows the protector in a bent position.

In order to stabilize the leg protector on the knee-joint area and to inhibit, on impact, the kneecap from bearing on the outer knee joint guard (e.g. via the pad 9), an inner kneecap guard part is provided. Referring to FIGS. 3 and 4 the inner kneecap guard part comprises a relatively resilient pad element 37. The pad element 37 is shown, by way of example only, as being integral with the pad 10, the pad element 37 being connected to the main body of the pad 10 by a narrow neck (pad) part 38. As in the case of the pad 10 the pad element 37 is preferably associated with a relatively rigid support element 41 made of material similar to that of the outer shells 5, 6 or 7. For this purpose, the pad element 37 also has, on the side thereof which faces the outer knee joint guard part, a peripherally extending pouch for receiving the peripheral edge 42 of the support element 41; the pouch has a slit opening 43 (dotted line) for receiving the edge 42. On the kneecap side of the pad element 37, a depression is defined for engaging the kneecap. The kneecap (not shown) is intended to nest in the depression and to thus bear against the pad element 37.

The support element 41, has a lower stem portion 44 which is provided with two hole 45. The upper part of the support 18 is provided with a projection 46 which has two corresponding holes 47. The holes 45 and 47 are configured so as to line up and permit the support element 41 to be connected to the support 18 by a rivet connection through these holes; the connection having a neck like aspect. The support element 41 is provided with a depression 48 which essentially conforms to the shape of the depression in the pad element 37, the pad element 37 being configured to nest in the depression 48.

The neck 38 and the neck like structure formed by connecting the stem portion 44 to the projection 46 are sufficiently flexible such that the pad element 37 and the support element 41 may pivot thereabout relative to the pad 10 and the support 18, and thus follow the bending movement of the leg about the knee; these necks thus define the second articulation connection means.

As seen in FIG. 3 and 4, a spacer element 49 is present. The spacer element 49 comprises a cup shaped head portion 50, a flexible neck portion 51 and a stem or root portion 52. The stem portion 52 is disposed between the shell 7 and the support 18, with the neck 51 being more or less disposed in an opening defined between the upper part of the support 18 and the shell 7; the spacer element 49 may be removed by simply pulling it out of the pocket 27 and replaced by pushing the stem 52 through the opening into the pocket 27.

The stem portion 52 maintains the spacer element 49 in position relative to the inner knee cap member (comprising the pad element 37).

The pad element 37 and the support element 41 are configured relative to the spacer element 49 so as to (slidingly) nest within head portion 50 of the spacer element 49. The spacer element 49 additionally has an opening 53 which seats the protrusion defined by the support element 41 (see FIG. 7).

The head portion 50 of the spacer element 49, is configured (i.e. sized) relative to the outer knee joint guard part and the other guard parts such that when the head 50 nests within the outer knee joint guard part, the support element 41 is spaced apart from the outer knee joint guard and a buffer pocket 54 is defined therebetween (see FIGS. 4 and 7).

In use, an upper part 55 (see FIG. 3) of head 50 is able to slidingly or rubbingly abut a lower inner part of the thigh portion 2, i.e. the upper part 55 is able to abut the cutaway lower part of the pad element 8 and these elements may slide relative to each other. The sides of the head 50 may also slidingly abut the opposed side walls of the pad element 9 in similar fashion. Thus, in response to bending action of the leg about the knee, the head 50 will pivot about the flexible neck 51; the inner knee cap member (comprising pad element 37) will pivot about neck parts 38 and 46; and the inner knee cap member (comprising pad element 37) will slidingly engage the head part 50 of the spacer element 49.

Although the embodiment shown in FIGS. 1 to 8 is shown with an upper thigh guard, the thigh guard may if desired be dispensed with; in this case, however, the upper part of the head 50 of the spacer element 49 will have to slidingly abut the upper inner edge of the pad element 9. Additionally, the spacer element 49 may, if desired be eliminated in favour of a peripherally enlarged pad element 37 wherein the enlarged periphery carries out the function of the spacer element 49; this mechanism will be described below in relation to the example arm protector shown in FIGS. 9 to 15.

Figure 3A:
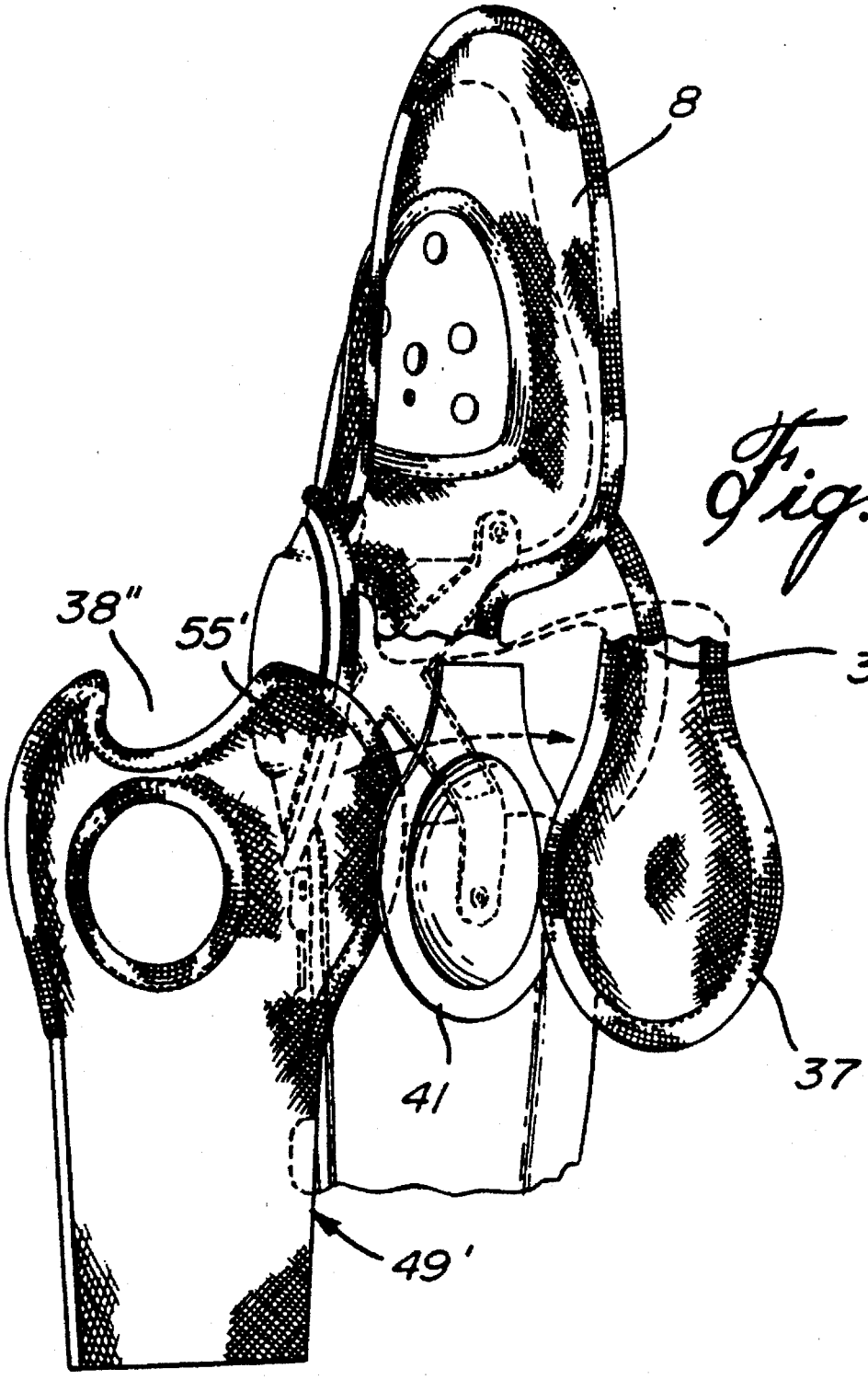
FIG. 3A is an exploded partially cut-out schematic rear view of an alternate embodiment of a leg protection device of the present invention.

Turning to FIG. 3*a*, in accordance with the present invention, the pad element 37 may alternatively be pivotally connected to (i.e. be integral with) the pad 8 of the thigh portion 2 instead of to the pad 10 of the shin portion 4. In this case the upper part 55' of the spacer element 49' may have a concave shaped notch 38" for receiving the flexible neck 38' of the pad element 37. In this case, the support element 41 may be held in place solely by the (above described) pouch of the pad element 37.

Turning to FIGS. 9 to 15, these figures illustrate an embodiment of the present invention for use to protect the elbow of a person.

As in the case of the leg protection device described above, the example arm protection device has three main components, namely, an upper arm portion 57, a middle elbow portion 58, and a forearm portion 59; in accordance with the present invention and, if desired, the upper arm portion 57 may not be present such that the device would in this case be essentially a forearm and elbow protector.

Figure 10:
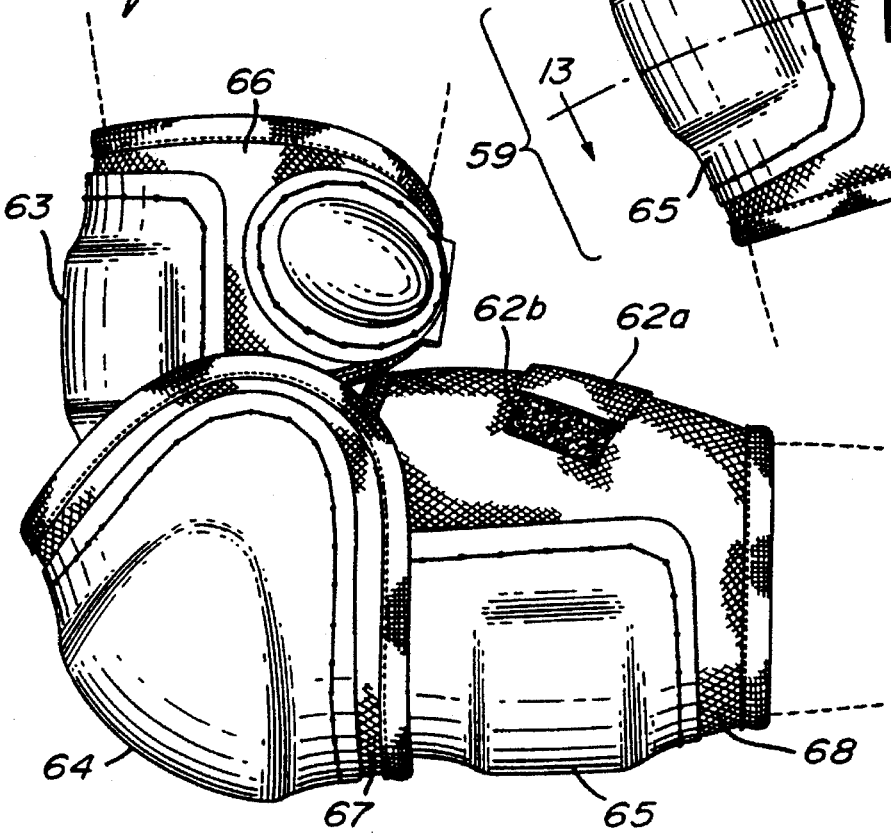
FIG. 10 shows a side view of the arm protector of FIG. 9 in a bent position.

As may be seen from FIGS. 9 to 14, the portion 58 of the arm protector is concavely curved about its longitudinal axis (i.e. the length axis of the arm) such that when the protector is placed on an arm it partially encircles the wearers elbow; see FIGS. 9 and 10 where the wearers arm is shown in dotted lines. On the other hand the portions 57 and 59 have flexible members which allow for the arm to be completely encircled thereby. The arm protector may be maintained in place on an arm in any suitable manner, for example, by releasable multiple (small) hook attachment means such as by velcro type connection means 60*a*, 60*b*, 61*a*, 61*b*, 62*a* and 62*b* shown in the FIGS. 9 to 15 or it may be maintained on the limb by a shirt sleeve which covers the protector.

Turning to FIG. 9, the upper arm portion 57, the outer elbow joint guard of the elbow portion 58 and the forearm portion 59 each comprises a protective relatively rigid outer shell 63, 64 and 65 respectively. These outer rigid shells overlie respective relatively resilient pad elements 66, 67 and 68 respectively.

The rigid elbow joint shell 64 and the pad 67 define, an outer elbow joint guard part. The rigid elbow joint shell 64 and the pad 67 are sized such that the border edges of the pad 67 extend beyond the peripheral edges of the shell 64. The rigid outer elbow joint shell 64 is attached to the pad 67 by stitching, i.e. the shell 64 is attached adjacent to the periphery of the pad 67.

The outer elbow joint guard part is shaped or configured such that it will cover the elbow (i.e. essentially the rear part of the joint between the upper arm and the forearm) and side parts of the elbow joint area of the arm of a wearer. The elbow area is protected primarily by the outer elbow shell 64, which is arranged (e.g. in relation to the surface curvature) such that (impact) forces are guided past the elbow and its adjacent fragile ligaments and articular cartilage and are transferred to stronger, surrounding parts of the elbow-joint.

The rigid shells 63 and 65 and the respective pads 66 and 68 are also sized such that the border edges of the pads extend beyond the peripheral edges of the shells. The rigid outer shells are also attached to the pads by stitching. Referring to FIG. 16, the portion 57, however, also has flexible pad extension elements 69 and 70 while the portion 59 has a flexible pad extension element 71. These flexible pad extension elements allow the protective portions 57 and 59 to be entirely wrapped around the arm. The extension element 71 may if desired be provided in its interior with a hard shell element for protecting the front of the forearm.

As in the case of the leg protection device the upper arm portion 57, the outer part of the elbow joint portion 58 and the forearm portion 59 are connected together by an articulation connection means comprising the same sort of first and second flexible web means; the articulation connection means permitting unrestricted movement of the elbow-joint.

Figure 14:
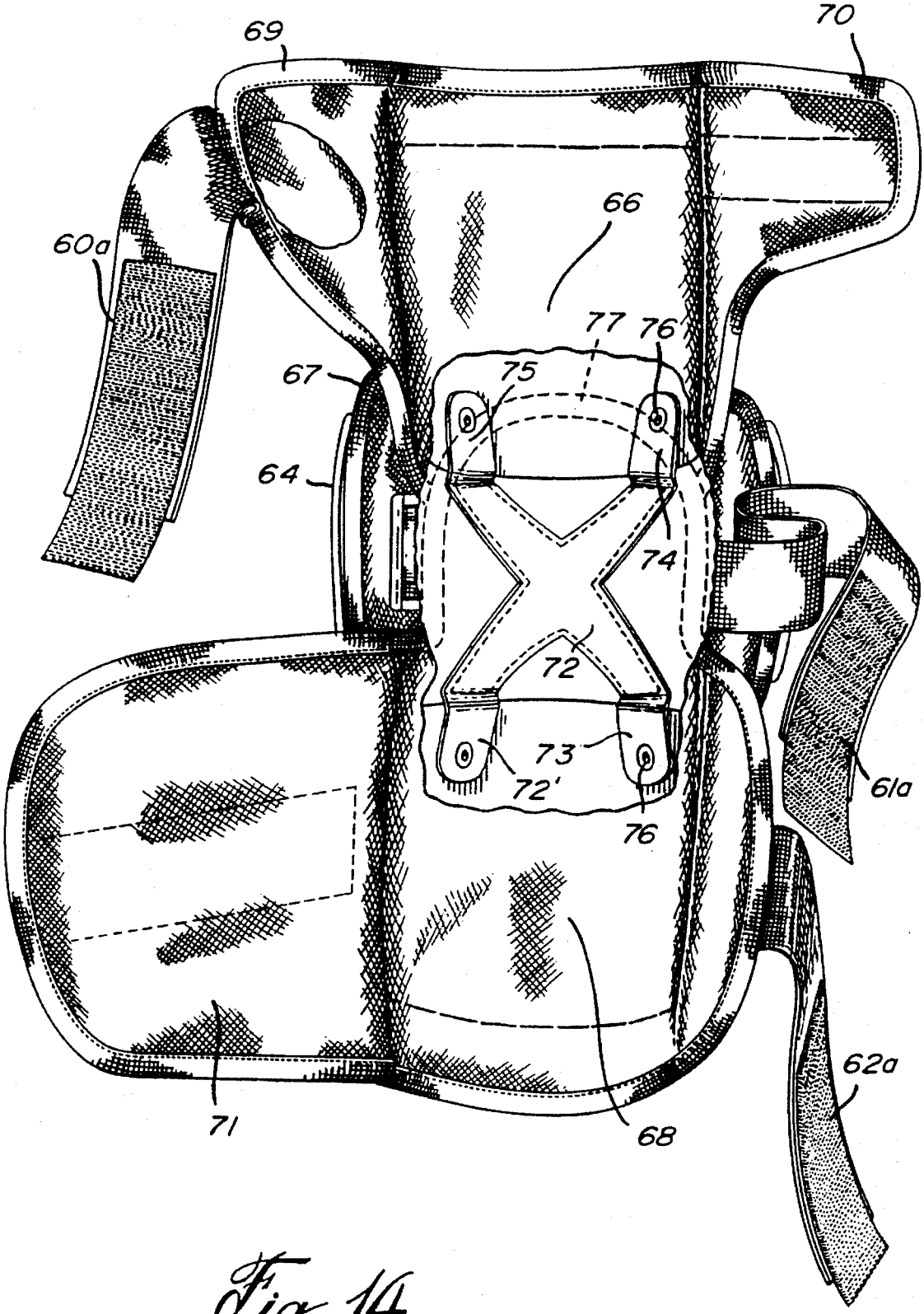
FIG. 14 shows a back view into the interior of the arm protector of FIG. 9 but with portions of the resilient pad elements removed to show the articulate connection between the upper, middle and forearm portions.

Referring to FIGS. 14 and 15, the first articulation connection means comprises a criss cross web member or band 72 which is sewn onto pad 67; the stitching is the same as for the leg protector in that it leaves free ends for connection to underlying edges parts of adjacent upper and forearm portions 57 and 59 which the outer elbow guard part overlaps. The free ends 72', 73, 74 and 75 of band member 72 (i.e. the portions thereof not stitched to the pad 67) are attached to the rigid shells 63 and 65 by rivet type connections (indicated generally by the reference numeral 76). The first flexible web means referred to above comprises the free ends 72' and 73 while the second flexible web means referred to above comprises the free ends 74 and 75.

Referring to FIG. 9 and 10, the first flexible web means permits pivotable back and forth movement of the outer elbow shell 64 relative to the forearm shell 65 in response to the bending (or articulate) movement of the arm about the elbow. Similarly, the second flexible web means permits pivotable back and forth movement of the upper shell 63 relative to the outer elbow shell 64 in response to the bending (or articulate) movement of the arm about the elbow; FIG. 9 shows the arm protector in a more or less straight position whereas FIG. 10 shows the protector in a bent position.

In order to stabilize the arm protector on the elbow-joint area and to inhibit, on impact, the elbow from bearing on the outer elbow joint guard (e.g. via the pad 67), an inner elbow guard part is provided. Referring to FIGS. 12, 15 and 16 the inner kneecap guard part comprises a relatively resilient pad element 77. The pad element 77 is, as shown in FIG. 16, integral with the pad 68, the pad element 77 being connected to the main body of the pad 68 by a flexible neck (pad) part 78. The pad element 77 is preferably associated with a relatively rigid cup-like support element 79 (see FIG. 12) made of material similar to that of the outer shells 5, 6 or 7. The rigid support element 79 is sewn to the pad element 77 about the periphery thereof on the side of the pad element which faces the outer elbow joint guard part. On the elbow side of the pad element 77 a depression 80 is defined by the pad element for engaging the elbow. The elbow (not shown) is intended to nest in the depression 80 and to thus bear against the pad element 77. The support element 79 is provided with a depression which essentially conforms to the shape of the depression 80 in the pad element 77, the pad element 77 being configured to nest in the depression of the support element 79.

The neck 78 is sufficiently flexible such that the pad element 77 with the support element 79 may pivot thereabout relative to the pad 68 and thus follow the bending movement of the arm about the elbow; this necks thus define the second articulation connection means.

The pad element 77 is also configured (i.e. sized) relative to the outer elbow joint guard part such that the pad element 77 nests within the outer elbow joint guard part but such that the support element 79 is spaced apart from the outer elbow joint and a buffer pocket 81 is defined therebetween (see FIGS. 12 and 15). For these purposes, an upper part 82 of the pad element 77 slidingly abuts a lower inner part 83 of the upper arm portion 57; the neck portion 78 abuts the upper edge portion 84 of the forearm portion 58; and the side wing parts of the pad element 77 slidingly abut the opposed side walls of the outer elbow joint part. Thus, in response to bending action of the arm about the elbow, the pad element 77 will pivot about the flexible neck 78.

I claim:

1. A leg protector for protecting a person's shin, knee and thigh, said leg protector being of the type arranged to at least partially encircle a person's leg, said leg protection system comprising an inner knee cap guard means comprising a resilient pad element for bearing on a person's knee cap, a leg guard, said leg guard comprising
- a shin guard means,
- an outer knee joint guard means, and
- a thigh guard means,
  - said shin guard means comprising a rigid outer shell element overlying a resilient shin pad element,
  - said outer knee joint guard means comprising a rigid outer shell element,
  - said thigh guard means comprising a rigid outer shell element overlying a resilient thigh pad element,
  - said outer knee joint guard means being in overlying relationship to said inner knee cap guard means,
  - said outer knee joint guard means, when the leg of the person is straight, being in overlapping relation to said shin and thigh guard means, means for attaching the resilient pad element of said shin guard means to the rigid outer shell element of said shin guard means, means for attaching the resilient pad element of said thigh guard means to the rigid outer shell element of said thigh guard means, spacing means for spacing apart the inner knee cap guard means from the outer knee joint guard means such that a buffer pocket is defined therebetween, said spacing means comprising a peripheral portion of said inner knee cap guard means, said peripheral portion being configured relative to said outer knee joint guard means, said shin guard means and said thigh guard means such that said inner knee cap guard means nests in said outer knee joint guard means, first articulation connection means for articulately connecting said outer knee joint guard means to said shin guard means and to said thigh guard means such that said outer knee joint guard means is pivotably moveable, relative to said shin guard means, in response to bending movement of the leg about the knee and said thigh guard means is pivotably moveable, relative to said outer knee joint guard means, in response to bending movement of the leg about the knee, and second articulation connection means for articulately connecting said inner knee cap guard means to said shin guard means such that said inner knee cap guard means is pivotably moveable, relative to said shin guard means, in response to bending movement of the leg about the knee, wherein said first articulation connection means comprises first flexible strap means for connecting said outer knee joint guard means to said shin guard means and second flexible strap means for connecting said outer knee joint guard means to said thigh guard means and wherein said inner knee cap guard means includes a rigid outer shell element overlying the resilient pad element of said inner knee cap guard means, and said leg protector includes means for attaching the resilient pad element of said inner knee cap guard to the rigid shell element of said inner knee cap guard means, the rigid shell element of said inner knee cap means being disposed between said outer knee joint guard means and the resilient pad element of said inner knee guard means.

2. An arm protector for protecting a person's forearm, elbow and upper arm, said arm protector being of the type arranged to at least partially encircle a person's arm, said arm protector comprising an inner elbow guard means comprising a resilient pad element for bearing on a person's elbow, an arm guard, said arm guard comprising
- a forearm guard means,
- an outer elbow joint guard means, and
- a upper arm guard means,
  - said forearm guard means comprising a rigid outer shell element overlying a resilient forearm pad element,
  - said outer elbow joint guard means comprising a rigid outer shell element,
  - said upper arm guard means comprising a rigid outer shell element overlying a resilient upper arm pad element,
  - said outer elbow joint guard means being in overlying relationship to said inner elbow guard means,
  - said outer elbow joint guard means, when the arm of the person is straight, being in overlapping relation to said forearm and upper arm guard means, means for attaching the resilient pad element of said forearm guard means to the rigid outer shell element of said forearm guard means, means for attaching the resilient pad element of said upper arm guard means to the rigid outer shell element of said upper arm guard means, spacing means for spacing apart the inner elbow guard means from the outer elbow joint guard means such that a buffer pocket is defined therebetween, said spacing means comprising a peripheral portion of said inner elbow guard means, said peripheral portion being configured relative to said outer elbow joint guard means, said forearm guard means and said upper arm guard means such that said inner elbow guard means nests in said outer elbow joint guard means, first articulation connection means for articulately connecting said outer elbow joint guard means to said forearm guard means and to said upper arm guard means such that said outer elbow joint guard means is pivotably moveable, relative to said forearm guard means, in response to bending movement of the arm about the elbow and said upper arm guard means is pivotably moveable, relative to said outer elbow joint guard means, in response to bending movement of the arm about the elbow, and second articulation connection means for articulately connecting said inner elbow guard means to said forearm guard means such that said inner elbow guard means is pivotably moveable, relative to said forearm guard means, in response to bending movement of the arm about the elbow, wherein said first articulation connection means comprises first flexible strap means for connecting said outer elbow joint guard means to said forearm guard means and second flexible strap means for connecting said outer elbow joint guard means to said upper arm guard means and wherein said inner elbow guard means includes a rigid outer shell element overlying the resilient pad element of said inner elbow guard means, and said arm protector includes means for attaching the resilient pad element of said inner elbow guard means to the rigid shell element of said inner elbow guard means, the rigid shell element of said inner elbow guard means being disposed between said outer elbow joint guard means and the resilient pad element of the inner elbow guard means.

3. A leg protector for protecting a person's shin, knee and thigh, said leg protector being of the type arranged to at least partially encircle a person's leg, said leg protection system comprising an inner knee cap guard means comprising a resilient pad element for bearing on a person's knee cap, a leg guard, said leg guard comprising
- a shin guard means,
- an outer knee joint guard means, and
- a thigh guard means,
  - said shin guard means comprising a rigid outer shell element overlying a resilient shin pad element,
  - said outer knee joint guard means comprising a rigid outer shell element,
  - said thigh guard means comprising a rigid outer shell element overlying a resilient thigh pad element,
  - said outer knee joint guard means being in overlying relationship to said inner knee cap guard means,
  - said outer knee joint guard means, when the leg of the person is straight, being in overlapping relation to said shin and thigh guard means, means for attaching the resilient pad element of said shin guard means to the rigid outer shell element of said shin guard means, means for attaching the resilient pad element of said thigh guard means to the rigid outer shell element of said thigh guard means, spacing means for spacing apart the inner knee cap guard means from the outer knee joint guard means such that a buffer pocket is defined therebetween, first articulation connection means for articulately connecting said outer knee joint guard means to said shin guard means and to said thigh guard means such that said outer knee joint guard means is pivotably moveable, relative to said shin guard means, in response to bending movement of the leg about the knee and said thigh guard means is pivotably moveable, relative to said outer knee joint guard means, in response to bending movement of the leg about the knee, and second articulation connection means for articulately connecting said inner knee cap guard means to said shin guard means such that said inner knee cap guard means is pivotably moveable, relative to said shin guard means, in response to bending movement of the leg about the knee said spacing means comprising a resilient spacer pad element, said spacer pad element being configured relative to said outer knee joint guard means, said inner knee cap guard means, said shin guard means and said thigh guard means such that the spacer pad element nests in the outer knee joint guard means between the inner knee cap guard means and the outer knee joint guard means, the inner knee cap guard means nests in said spacer pad element and, in response to bending movement of the leg about the knee, the inner knee cap guard means is able to slidably engage the spacer pad element.

4. A leg protector as defined in claim 1 wherein said first articulation connection means comprises first flexible strap means for connecting said outer knee joint guard means to said shin guard means and second flexible strap means for connecting said outer knee joint guard means to said thigh guard means.

5. A leg protector as defined in claim 4 wherein said inner knee cap guard means includes a rigid outer shell element overlying the resilient pad element of said inner knee cap guard means, and said leg protector includes means for attaching the resilient pad element of said inner knee cap guard to the rigid shell of said inner knee cap guard means, the rigid shell element of said inner knee cap means being disposed between said outer knee joint guard means and the resilient pad element of said inner knee guard means.

6. A leg protector for protecting a person's shin, knee and thigh, said leg protector being of the type arranged to at least partially encircle a person's leg, said leg protection system comprising an inner knee cap guard means comprising a resilient pad element for bearing on a person's knee cap, a leg guard, said leg guard comprising
- a shin guard means,
- an outer knee joint guard means, and
- a thigh guard means,
  - said shin guard means comprising a rigid outer shell element overlying a resilient shin pad element,
  - said outer knee joint guard means comprising a rigid outer shell element overlying a resilient knee pad element,
  - said thigh guard means comprising a rigid outer shell element overlying a resilient thigh pad element,
  - said outer knee joint guard means being in overlying relationship to said inner knee cap guard means,
  - said outer knee joint guard means, when the leg of the person is straight, being in overlapping relation to said shin and thigh guard means, means for attaching the resilient pad element of said shin guard means to the rigid outer shell element of said shin guard means, means for attaching the resilient pad element of said outer knee joint guard means to the rigid outer shell element of said outer knee joint guard means, means for attaching the resilient pad element of said thigh guard means to the rigid outer shell element of said thigh guard means, spacing means for spacing apart the inner knee cap guard means from the outer knee joint guard means such that a buffer pocket is defined therebetween, said spacing means being a resilient spacing means, first articulation connection means for articulately connecting said outer knee joint guard means to said shin guard means and to said thigh guard means such that said outer knee joint guard means is pivotably moveable, relative to said shin guard means, in response to bending movement of the leg about the knee and said thigh guard means is pivotably moveable, relative to said outer knee joint guard means, in response to bending movement of the leg about the knee, and second articulation connection means for articulately connecting said inner knee cap guard means to said shin guard means such that said inner knee cap guard means is pivotably moveable, relative to said shin guard means, in response to bending movement of the leg about the knee said first articulation connection means comprising first flexible strap means for connecting said outer knee joint guard means to said shin guard means and second flexible strap means for connecting said outer knee joint guard means to said thigh guard means, said first and second flexible strap means being in underlying relation with respect to the rigid outer shell elements of said shin, outer knee joint and thigh guard means.

7. A leg protector as defined in claim 6 wherein said spacer means comprises a peripheral portion of said inner knee cap guard means, said peripheral portion being configured relative to said outer knee joint guard means, said shin guard means and said thigh guard means such that said inner knee cap guard means nests in said outer knee joint guard means.

8. A leg protector as defined in claim 7 wherein said inner knee cap guard means includes a rigid outer shell element overlying the resilient pad element of said inner knee cap guard means, and said leg protector includes means for attaching the resilient pad element of said inner knee cap guard to the rigid shell of said inner knee cap guard means, the rigid shell element of said inner knee cap means being disposed between said outer knee joint guard means and the resilient pad element of said inner knee guard means.

9. An arm protector for protecting a person's forearm, elbow and upper arm, said arm protector being of the type arranged to at least partially encircle a person's arm, said arm protector comprising an inner elbow guard means comprising a resilient pad element for bearing on a person's elbow, an arm guard, said arm guard comprising
- a forearm guard means,
- an outer elbow joint guard means, and
- a upper arm guard means,
  - said forearm guard means comprising a rigid outer shell element overlying a resilient forearm pad element, said outer elbow joint guard means comprising a rigid outer shell element, said upper arm guard means comprising a rigid outer shell element overlying a resilient upper arm pad element, said outer elbow joint guard means being in overlying relationship to said inner elbow guard means, said outer elbow joint guard means, when the arm of the person is straight, being in overlapping relation to said forearm and upper arm guard means, means for attaching the resilient pad element of said forearm guard means to the rigid outer shell element of said forearm guard means, means for attaching the resilient pad element of said upper arm guard means to the rigid outer shell element of said upper arm guard means, spacing means for spacing apart the inner elbow guard means from the outer elbow joint guard means such that a buffer pocket is defined therebetween, first articulation connection means for articulately connecting said outer elbow joint guard means to said forearm guard means and to said upper arm guard means such that said outer elbow joint guard means is pivotably moveable, relative to said forearm guard means, in response to bending movement of the arm about the elbow and said upper arm guard means is pivotably moveable, relative to said outer elbow joint guard means, in response to bending movement of the arm about the elbow, and second articulation connection means for articulately connecting said inner elbow guard means to said forearm guard means such that said inner elbow guard means is pivotably moveable, relative to said forearm arm guard means, in response to bending movement of the arm about the elbow, said spacing means comprising a resilient spacer pad element, said spacer pad element being configured relative to said outer elbow joint guard means, said inner elbow guard means, said forearm guard means and said upper arm guard means such that the spacer pad element nests in the outer elbow joint guard means between the inner elbow guard means and the outer elbow joint guard means, the inner elbow guard means nests in said spacer pad element and, in response to bending movement of the arm about the elbow, the inner elbow guard means is able to slidably engage the spacer pad element.

10. An arm protector as defined in claim 9 wherein said first articulation connection means comprises first flexible strap means for connecting said outer elbow joint guard means to said forearm guard means and second flexible strap means for connecting said outer elbow joint guard means to said upper arm guard means.

11. An arm protector as defined in claim 10 wherein said inner elbow guard means includes a rigid outer shell element overlying the resilient pad element of said inner elbow guard means, and said arm protector includes means for attaching the resilient pad element of said inner elbow guard means to the rigid shell element of said inner elbow guard means, the rigid shell element of said inner elbow guard means being disposed between said outer elbow joint guard means and the resilient pad element of the inner elbow guard means.

12. An arm protector for protecting a person's forearm, elbow and upper arm, said arm protector being of the type arranged to at least partially encircle a person's arm, said arm protector comprising an inner elbow guard means comprising a resilient pad element for bearing on a person's elbow, an arm guard, said arm guard comprising a forearm guard means, an outer elbow joint guard means, and a upper arm guard means, said forearm guard means comprising a rigid outer shell element overlying a resilient forearm pad element, said outer elbow joint guard means comprising a rigid outer shell element overlying a resilient elbow pad element, said upper arm guard means comprising a rigid outer shell element overlying a resilient upper arm pad element, said outer elbow joint guard means being in overlying relationship to said inner elbow guard means, said outer elbow joint guard means, when the arm of the person is straight, being in overlapping relation to said forearm and upper arm guard means, means for attaching the resilient pad element of said forearm guard means to the rigid outer shell element of said forearm guard means, means for attaching the resilient pad element of said outer elbow joint guard means to the rigid outer shell element of outer elbow joint guard means, means for attaching the resilient pad element of said upper arm guard means to the rigid outer shell element of upper aarm guard means, spacing means for spacing apart the inner elbow guard means from the outer elbow joint guard means such that a buffer pocket is defined therebetween, said spacing means being a resilient spacing means, first articulation connection means for articulately connecting said outer elbow joint guard means to said forearm guard means and to said upper arm guard means such that said outer elbow joint guard means is pivotably moveable, relative to said forearm guard means, in response to bending movement of the arm about the elbow and said upper arm guard means is pivotably moveable, relative to said outer elbow joint guard means, in response to bending movement of the arm about the elbow, and second articulation connection means for articulately connecting said inner elbow guard means to said forearm guard means such that said inner elbow guard means is pivotably moveable, relative to said forearm, in response to bending movement of the arm about the elbow, said first articulation connection means comprising first flexible strap means for connecting said outer elbow joint guard means to said forearm guard means and second flexible strap means for connecting said outer elbow joint guard means to said upper arm guard means, said first and second flexible strap means being in underlying relation with respect to the rigid outer shell elements of said forearm, outer elbow joint and upper arm guard means.

13. An arm protector as defined in claim 12 wherein said spacer means comprises a peripheral portion of said inner elbow guard means, said peripheral portion being configured relative to said outer elbow joint guard means, said forearm guard means and said upper arm guard means such that said inner elbow guard means nests in said outer elbow joint guard means.

14. An arm protector as defined in claim 13 wherein said inner elbow guard means includes a rigid outer shell element overlying the resilient pad element of said inner elbow guard means, and said arm protector includes means for attaching the resilient pad element of said inner elbow guard means to the rigid shell element of said inner elbow guard means, the rigid shell element of said inner elbow guard means being disposed between said outer elbow joint guard means and the resilient pad element of the inner elbow guard means.

15. A leg protector for protecting a person's shin, knee and thigh, said leg protector being of the type arranged to at least partially encircle a person's leg, said leg protection system comprising an inner knee cap guard means comprising a resilient pad element for bearing on a person's knee cap, a leg guard, said leg guard comprising
- a shin guard means,
- an outer knee joint guard means, and
- a thigh guard means,
  - said shin guard means comprising a rigid outer shell element overlying a resilient shin pad element,
  - said outer knee joint guard means comprising a rigid outer shell element,
  - said thigh guard means comprising a rigid outer shell element overlying a resilient thigh pad element,
  - said outer knee joint guard means being in overlying relationship to said inner knee cap guard means,
  - said outer knee joint guard means, when the leg of the person is straight, being in overlapping relation to said shin and thigh guard means, means for attaching the resilient pad element of said shin guard means to the rigid outer shell element of said shin guard means, means for attaching the resilient pad element of said thigh guard means to the rigid outer shell element of said thigh guard means, spacing means for spacing apart the inner knee cap guard means from the outer knee joint guard means such that a buffer pocket is defined therebetween, said spacing means comprising a peripheral portion of said inner knee cap guard means, said peripheral portion being configured relative to said outer knee joint guard means, said shin guard means and said thigh guard means such that said inner knee cap guard means nests in said outer knee joint guard means, first articulation connection means for articulately connecting said outer knee joint guard means to said shin guard means and to said thigh guard means such that said outer knee joint guard means is pivotably moveable, relative to said shin guard means, in response to bending movement of the leg about the knee and said thigh guard means is pivotably moveable, relative to said outer knee joint guard means, in response to bending movement of the leg about the knee, and second articulation connection means for articulately connecting said inner knee cap guard means to said thigh guard means such that said inner knee cap guard means is pivotably moveable, relative to said thigh guard means, in response to bending movement of the leg about the knee, wherein said first articulation connection means comprises first flexible strap means for connecting said outer knee joint guard means to said shin guard means and second flexible strap means for connecting said outer knee joint guard means to said thigh guard means and wherein said inner knee cap guard means includes a rigid outer shell element overlying the resilient pad element of said inner knee cap guard means, and said leg protector includes means for attaching the resilient pad element of said inner knee cap guard to the rigid shell element of said inner knee cap guard means, the rigid shell element of said inner knee cap means being disposed between said outer knee joint guard means and the resilient pad element of said inner knee guard means.

16. An arm protector for protecting a person's forearm, elbow and upper arm, said arm protector being of the type arranged to at least partially encircle a person's arm, said arm protector comprising an inner elbow guard means comprising a resilient pad element for bearing on a person's elbow, an arm guard, said arm guard comprising
- a forearm guard means,
- an outer elbow joint guard means, and
- a upper arm guard means,
  - said forearm guard means comprising a rigid outer shell element overlying a resilient forearm pad element,
  - said outer elbow joint guard means comprising a rigid outer shell element,
  - said upper arm guard means comprising a rigid outer shell element overlying a resilient upper arm pad element,
  - said outer elbow joint guard means being in overlying relationship to said inner elbow guard means,
  - said outer elbow joint guard means, when the arm of the person is straight, being in overlapping relation to said forearm and upper arm guard means, means for attaching the resilient pad element of said forearm guard means to the rigid outer shell element of said forearm guard means, means for attaching the resilient pad element of said upper arm guard means to the rigid outer shell element of said upper arm guard means, spacing means for spacing apart the inner elbow guard means from the outer elbow joint guard means such that a buffer pocket is defined therebetween, said spacing means comprising a peripheral portion of said inner elbow guard means, said peripheral portion being configured relative to said outer elbow joint guard means, said forearm guard means and said upper arm guard means such that said inner elbow guard means nests in said outer elbow joint guard means, first articulation connection means for articulately connecting said outer elbow joint guard means to said forearm guard means and to said upper arm guard means such that said outer elbow joint guard means is pivotably moveable, relative to said forearm guard means, in response to bending movement of the arm about the elbow and said upper arm guard means is pivotably moveable, relative to said outer elbow joint guard means, in response to bending movement of the arm about the elbow, and second articulation connection means for articulately connecting said inner elbow guard means to one of said forearm guard means and said upper arm guide means such that said inner elbow guard means is pivotably moveable, relative to a respective one of said forearm and upper arm guard means, in response to bending movement of the arm about the elbow, wherein said first articulation connection means comprises first flexible strap means for connecting said outer elbow joint guard means to said forearm guard means and second flexible strap means for connecting said outer elbow joint guard means to said upper arm guard means and wherein said inner elbow guard means includes a rigid outer shell element overlying the resilient pad element of said inner elbow guard means, and said arm protector includes means for attaching the resilient pad element of said inner elbow guard means to the rigid shell element of said inner elbow guard means, the rigid shell element of said inner elbow guard means being disposed between said outer elbow joint guard means and the resilient pad element of the inner elbow guard means.

17. A leg protector for protecting a person's shin, knee and thigh, said leg protector being of the type arranged to at least partially encircle a person's leg, said leg protection system comprising an inner knee cap guard means comprising a resilient pad element for bearing on a person's knee cap, a leg guard, said leg guard comprising
a shin guard means,
an outer knee joint guard means, and
a thigh guard means,
said shin guard means comprising a rigid outer shell element overlying a resilient shin pad element,
said outer knee joint guard means comprising a rigid outer shell element,
said thigh guard means comprising a rigid outer shell element overlying a resilient thigh pad element,
said outer knee joint guard means being in overlying relationship to said inner knee cap guard means,
said outer knee joint guard means, when the leg of the person is straight, being in overlapping relation to said shin and thigh guard means, means for attaching the resilient pad element of said shin guard means to the rigid outer shell element of said shin guard means, means for attaching the resilient pad element of said thigh guard means to the rigid outer shell element of said thigh guard means,, spacing means for spacing apart the inner knee cap guard means from the outer knee joint guard means such that a buffer pocket is defined therebetween, first articulation connection means for articulately connecting said outer knee joint guard means to said shin guard means and to said thigh guard means such that said outer knee joint guard means is pivotably moveable, relative to said shin guard means, in response to bending movement of the leg about the knee and said thigh guard means is pivotably moveable, relative to said outer knee joint guard means, in response to bending movement of the leg about the knee, and second articulation connection means for articulately connecting said inner knee cap guard means to said thigh guard means such that said inner knee cap guard means is pivotably moveable, relative to said thigh guard means, in response to bending movement of the leg about the knee said spacing means comprising a resilient spacer pad element, said spacer pad element being configured relative to said outer knee joint guard means, said inner knee cap guard means, said shin guard means and said thigh guard means such that the spacer pad element nests in the outer knee joint guard means between the inner knee cap guard means and the outer knee joint guard means, the inner knee cap guard means nests in said spacer pad element and, in response to bending movement of the leg about the knee, the inner knee cap guard means is able to slidably engage the spacer pad element.

18. A leg protector as defined in claim 17 wherein said first articulation connection means comprises first flexible strap means for connecting said outer knee joint guard means to said shin guard means and second flexible strap means for connecting said outer knee joint guard means to said thigh guard means.

19. A leg protector as defined in claim 18 wherein said inner knee cap guard means includes a rigid outer shell element overlying the resilient pad element of said inner knee cap guard means, and said leg protector includes means for attaching the resilient pad element of said inner knee cap guard to the rigid shell of said inner knee cap guard means, the rigid shell element of said inner knee cap means being disposed between said outer knee joint guard means and the resilient pad element of said inner knee guard means.

20. A leg protector for protecting a person's shin, knee and thigh, said leg protector being of the type arranged to at least partially encircle a person's leg, said leg protection system comprising an inner knee cap guard means comprising a resilient pad element for bearing on a person's knee cap, a leg guard, said leg guard comprising
a shin guard means,
an outer knee joint guard means, and
a thigh guard means,
said shin guard means comprising a rigid outer shell element overlying a resilient shin pad element,
said outer knee joint guard means comprising a rigid outer shell element overlying a resilient knee pad element,
said thigh guard means comprising a rigid outer shell element overlying a resilient thigh pad element,
said outer knee joint guard means being in overlying relationship to said inner knee cap guard means,
said outer knee joint guard means, when the leg of the person is straight, being in overlapping relation to said shin and thigh guard means, means for attaching the resilient pad element of said shin guard means to the rigid outer shell element of said shin guard means, means for attaching the resilient pad element of said outer knee joint guard means to the rigid outer shell element of said outer knee joint guard means, means for attaching the resilient pad element of said thigh guard means to the rigid outer shell element of said thigh guard means, spacing means for spacing apart the inner knee cap guard means from the outer knee joint guard means such that a buffer pocket is defined therebetween, said spacing means being a resilient spacing means, first articulation connection means for articulately connecting said outer knee joint guard means to said shin guard means and to said thigh guard means such that said outer knee joint guard means is pivotably moveable, relative to said shin guard means, in response to bending movement of the leg about the knee and said thigh guard means is pivotably moveable, relative to said outer knee joint guard means, in response to bending movement of the leg about the knee, and second articulation connection means for articulately connecting said inner knee cap guard means to said thigh guard means such that said inner knee cap guard means is pivotably moveable, relative to said thigh guard means, in response to bending movement of the leg about the knee said first articulation connection means comprising first flexible strap means for connecting said outer knee joint guard means to said shin guard means and second flexible strap means for connecting said outer knee joint guard means to said thigh guard means, said first and second flexible strap means being in underlying relation with respect to the rigid outer shell elements of said shin, outer knee joint and thigh guard means.

21. A leg protector as defined in claim 20 wherein said spacer means comprises a peripheral portion of said inner knee cap guard means, said peripheral portion being configured relative to said outer knee joint guard means, said shin guard means and said thigh guard means such that said inner kneecap guard means nests in said outer knee joint guard means.

22. A leg protector as defined in claim 21 wherein said inner knee cap guard means includes a rigid outer shell element overlying the resilient pad element of said inner knee cap guard means, and said leg protector includes means for attaching the resilient pad element of said inner knee cap guard to the rigid shell of said inner knee cap guard means, the rigid shell element of said inner knee cap means being disposed between said outer knee joint guard means and the resilient pad element of said inner knee guard means.

23. An arm protector for protecting a person's forearm, elbow and upper arm, said arm protector being of the type arranged to at least partially encircle a person's arm, said arm protector comprising an inner elbow guard means comprising a resilient pad element for bearing on a person's elbow, an arm guard, said arm guard comprising
- a forearm guard means,
- an outer elbow joint guard means, and
- a upper arm guard means,
  - said forearm guard means comprising a rigid outer shell element overlying a resilient forearm pad element,
  - said outer elbow joint guard means comprising a rigid outer shell element,
  - said upper arm guard means comprising a rigid outer shell element overlying a resilient upper arm pad element,
  - said outer elbow joint guard means being in overlying relationship to said inner elbow guard means,
  - said outer elbow joint guard means, when the arm of the person is straight, being in overlapping relation to said forearm and upper arm guard means, means for attaching the resilient pad element of said forearm guard means to the rigid outer shell element of said forearm guard means, means for attaching the resilient pad element of said upper arm guard means to the rigid outer shell element of said upper arm guard means, spacing means for spacing apart the inner elbow guard means from the outer elbow joint guard means such that a buffer pocket is defined therebetween, first articulation connection means for articulately connecting said outer elbow joint guard means to said forearm guard means and to said upper arm guard means such that said outer elbow joint guard means is pivotably moveable, relative to said forearm guard means, in response to bending movement of the arm about the elbow and said upper arm guard means is pivotably moveable, relative to said outer elbow joint guard means, in response to bending movement of the arm about the elbow, and second articulation connection means for articulately connecting said inner elbow guard means to one of said forearm guard means and said upper arm guard means such that said inner elbow guard means is pivotably moveable, relative to a respective one of said forearm and upper arm guard means, in response to bending movement of the arm about the elbow, said spacing means comprising a resilient spacer pad element, said spacer pad element being configured relative to said outer elbow joint guard means, said inner elbow guard means, said forearm guard means and said upper arm guard means such that the spacer pad element nests in the outer elbow joint guard means between the inner elbow guard means and the outer elbow joint guard means, the inner elbow guard means nests in said spacer pad element and, in response to bending movement of the arm about the elbow, the inner elbow guard means is able to slidably engage the spacer pad element.

24. An arm protector as defined in claim 23 wherein said first articulation connection means comprises first flexible strap means for connecting said outer elbow joint guard means to said forearm guard means and second flexible strap means for connecting said outer elbow joint guard means to said upper arm guard means.

25. An arm protector as defined in claim 24 wherein said inner elbow guard means includes a rigid outer shell element overlying the resilient pad element of said inner elbow guard means, and said arm protector includes means for attaching the resilient pad element of said inner elbow guard means to the rigid shell element of said inner elbow guard means, the rigid shell element of said inner elbow guard means being disposed between said outer elbow joint guard means and the resilient pad element of the inner elbow guard means.

26. An arm protector for protecting a person's forearm, elbow and upper arm, said arm protector being of the type arranged to at least partially encircle a person's arm, said arm protector comprising an inner elbow guard means comprising a resilient pad element for bearing on a person's elbow, an arm guard, said arm guard comprising
- a forearm guard means,
- an outer elbow joint guard means, and
- a upper arm guard means,
  - said forearm guard means comprising a rigid outer shell element overlying a resilient forearm pad element,
  - said outer elbow joint guard means comprising a rigid outer shell element overlying a resilient elbow pad element,
  - said upper arm guard means comprising a rigid outer shell element overlying a resilient upper arm pad element,
  - said outer elbow joint guard means being in overlying relationship to said inner elbow guard means,
  - said outer elbow joint guard means, when the arm of the person is straight, being in overlapping relation to said forearm and upper arm guard means, means for attaching the resilient pad element of said forearm guard means to the rigid outer shell element of said forearm guard means, means for attaching the resilient pad element of said outer elbow joint guard means to the rigid outer shell element of outer elbow joint guard means, means for attaching the resilient pad element of said upper arm guard means to the rigid outer shell element of upper aarm guard means, spacing means for spacing apart the inner elbow guard means from the outer elbow joint guard means such that a buffer pocket is defined therebetween, said spacing means being a resilient spacing means, first articulation connection means for articulately connecting said outer elbow joint guard means to said forearm guard means and to said upper arm guard means such that said outer elbow joint guard means is pivotably moveable, relative to said forearm guard means, in response to bending movement of the arm about the elbow and said upper arm guard means is pivotably moveable, relative to said outer elbow joint guard means, in response to bending movement of the arm about the elbow, and second articulation connection means for articulately connecting said inner elbow guard means to one of said forearm guard means and said upper arm guard means such that said inner elbow guard means is pivotably moveable, relative to a respective one of said forearm and upper arm guard means, in response to bending movement of the arm about the elbow, said first articulation connection means comprising first flexible strap means for connecting said outer elbow joint guard means to said forearm guard means and second flexible strap means for connecting said outer elbow joint guard means to said upper arm guard means, said first and second flexible strap means being in underlying relation with respect to the rigid outer shell elements of said forearm, outer elbow joint and upper arm guard means.

27. An arm protector as defined in claim 26 wherein said spacer means comprises a peripheral portion of said inner elbow guard means, said peripheral portion being configured relative to said outer elbow joint guard means, said forearm guard means and said upper arm guard means such that said inner elbow guard means nests in said outer elbow joint guard means.

28. An arm protector as defined in claim 27 wherein said inner elbow guard means includes a rigid outer shell element overlying the resilient pad element of said inner elbow guard means, and said arm protector includes means for attaching the resilient pad element of said inner elbow guard means to the rigid shell element of said inner elbow guard means, the rigid shell element of said inner elbow guard means being disposed between said outer elbow joint guard means and the resilient pad element of the inner elbow guard means.

* * * * *